US010352201B2

(12) United States Patent
Okamoto

(10) Patent No.: US 10,352,201 B2
(45) Date of Patent: Jul. 16, 2019

(54) VALVE MECHANISM OF ENGINE

(71) Applicant: YAMAHA HATSUDOKI KABUSHIKI KAISHA, Iwata-shi, Shizuoka (JP)

(72) Inventor: Yasuo Okamoto, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 15/761,162

(22) PCT Filed: Jan. 13, 2016

(86) PCT No.: PCT/JP2016/050786
§ 371 (c)(1),
(2) Date: Mar. 19, 2018

(87) PCT Pub. No.: WO2017/061130
PCT Pub. Date: Apr. 13, 2017

(65) Prior Publication Data

US 2018/0266281 A1 Sep. 20, 2018

(30) Foreign Application Priority Data

Oct. 5, 2015 (JP) ..... 2015-197493

(51) Int. Cl.
*F01L 1/34* (2006.01)
*F01L 1/18* (2006.01)
(Continued)

(52) U.S. Cl.
CPC ..... *F01L 1/182* (2013.01); *F01L 1/047* (2013.01); *F01L 1/08* (2013.01); *F01L 1/18* (2013.01);
(Continued)

(58) Field of Classification Search
CPC ..... F01L 1/18; F01L 1/047; F01L 1/46; F01L 1/182; F01L 1/08; F01L 13/00; F01L 13/0005; F01L 13/0063
See application file for complete search history.

(56) References Cited

U.S. PATENT DOCUMENTS 4,656,977 A 4/1987 Nagahiro et al.
2011/0088642 A1 4/2011 Ezaki
(Continued)

FOREIGN PATENT DOCUMENTS

EP 2 472 075 A1 7/2012
EP 3 163 037 A1 5/2017
(Continued)

OTHER PUBLICATIONS

Official Communication issued in International Patent Application No. PCT/JP2016/050786, dated Apr. 12, 2016.
(Continued)

*Primary Examiner* — Zelalem Eshete
(74) *Attorney, Agent, or Firm* — Keating & Bennett LLP

(57) ABSTRACT

A valve mechanism for an engine includes a camshaft, a rocker arm, a synchronization cam that rotates in synchronism with a valve driving cam, and a switch assembly that switches the driving state of an intake valve or an exhaust valve when a cam follower is pressed by the synchronization cam. The synchronization cam presses the cam follower at a time when the intake valve or the exhaust valve is closed. The switch assembly includes a switch unit that switches the driving state when a switch moves, a driver that drives the switch via a transmission, and a positioner including a spring-biased presser that engages with a concave portion of the transmission. The concave portion includes a first concave portion with which the presser engages in a first driving state, and a second concave portion with which the presser engages in a second driving state.

6 Claims, 18 Drawing Sheets

(51) Int. Cl.

| | |
|---|---|
| ***F01L 13/00*** | (2006.01) |
| ***F01L 1/047*** | (2006.01) |
| ***F01L 1/08*** | (2006.01) |
| ***F01L 1/46*** | (2006.01) |

(52) U.S. Cl.
CPC ..... *F01L 1/46* (2013.01); *F01L 13/00* (2013.01); *F01L 13/0005* (2013.01); *F01L 13/0063* (2013.01)

(56) References Cited

U.S. PATENT DOCUMENTS

| | | | | |
|---|---|---|---|---|
| 2012/0037106 | A1 | 2/2012 | Werler et al. | |
| 2012/0055428 | A1* | 3/2012 | Kidooka ..... | F01L 1/185 123/90.16 |
| 2012/0222635 | A1 | 9/2012 | Sunada et al. | |

FOREIGN PATENT DOCUMENTS

| | | | |
|---|---|---|---|
| JP | 60-062613 | A | 4/1985 |
| JP | 2009-293613 | A | 12/2009 |
| JP | 2009-294199 | A | 12/2009 |
| JP | 2013-151940 | A | 8/2013 |
| JP | 2015-183629 | A | 10/2015 |
| WO | 2015/199066 | A1 | 12/2015 |

OTHER PUBLICATIONS

Official Communication issued in European Patent Application No. 16853286.9, dated Mar. 20, 2019.

* cited by examiner

〈CONNECTED STATE〉

〈NON-CONNECTED STATE〉

〈PRESSING START POSITION〉

〈CONNECTED STATE〉

VALVE MECHANISM OF ENGINE

BACKGROUND OF THE INVENTION

1. Field of the Invention

The present invention relates to a valve mechanism for an engine, which includes a switch assembly that switches a driving state of an intake valve or an exhaust valve of the engine.

2. Description of the Related Art

Conventionally, as a valve mechanism capable of switching the driving state of an intake valve or an exhaust valve of an engine, for example, there exists a valve mechanism described in Japanese Patent Laid-Open No. 2009-264199.

The valve mechanism disclosed in Japanese Patent Laid-Open No. 2009-264199 includes two types of rocker arms each of which changes the rotation of the cam of a camshaft into a reciprocal motion and transmits it to the intake valve or the exhaust valve, and a switch assembly that switches the driving state of the intake valve or the exhaust valve. The cam includes a first cam with a relatively large valve lift amount, and a second cam with a relatively small valve lift amount.

The two types of rocker arms are formed from a first rocker arm that is pressed by the first cam and swings, and a second rocker arm swingably provided at a position where the second cam can be pressed. The second rocker arm includes a pressing portion that presses the intake valve or the exhaust valve.

The switch assembly includes a slide pin that selectively connects the above-described two types of rocker arms, an actuator that applies an oil pressure to the slide pin, a return spring that returns the slide pin into one rocker arm, and the like. The switch assembly switches between a state in which the first rocker arm and the second rocker arm are connected to each other and integrally swing and a state in which the connection of the two rocker arms is canceled.

A pin hole through which the slide pin passes is provided in each of the rocker arms. The pin hole extends in the axial direction of the swing shaft of each rocker arm. The pin hole of the first rocker arm and the pin hole of the second rocker arm are formed at positions arranged on the same axis in a state in which the positions of the two rocker arms in the swing direction match.

The slide pin is pressed by the oil pressure and thus moves in the axial direction of the swing shaft of the rocker arm in the above-described pin hole against the spring force of a return spring. When the oil pressure disappears, the slide pin pressed and moved by the oil pressure is returned into one original rocker arm by the spring force of the return spring.

The first rocker arm and the second rocker arm are connected to each other when the slide pin moves to a connecting position across the rocker arms. The connected state is canceled when the slide pin is moved by the spring force of the return spring to a non-connecting position where the slide pin is housed in one original rocker arm.

When the slide pin is located at the connecting position, a driving force is transmitted from the first cam to the intake valve or the exhaust valve via the first rocker arm and the second rocker arm. On the other hand, when the slide pin is located at the non-connecting position, the driving force is not transmitted from the first rocker arm to the second rocker arm, and the driving force is transmitted from the second cam to the intake valve or the exhaust valve via the second rocker arm. For this reason, in the valve mechanism of the engine, the driving state of the intake valve or the exhaust valve is switched by changing the position of the slide pin.

In the valve mechanism described in Japanese Patent Laid-Open No. 2009-264199, to set the first rocker arm and the second rocker arm in the connected state, the oil pressure that presses the slide pin is applied to the slide pin. The time when the slide pin can move is the time when the first rocker arm and the second rocker arm have the same swing angle, and the pin holes of the two arms are arranged on the same axis. At a time when the pin holes are not arranged on the same axis, the slide pin cannot move, and therefore, the two arms are not connected. The time when the two arms have the same swing angle is the time when the intake valve or the exhaust valve is closed.

On the other hand, in a state in which the slide pin moves to the connecting position, and the driving force is transmitted from the first rocker arm to the second rocker arm, the slide pin is pressed against the hole wall surface of each pin hole by a force equivalent to the driving force. In this driving state, if a frictional force generated at the contact portion between the slide pin and the hole wall surface of the pin hole is large, the movement of the slide pin is regulated by the frictional force. Even if the oil pressure is canceled to return the slide pin to the non-connecting position by the spring force of the return spring in the driving state in which the large frictional force acts on the slide pin, the slide pin cannot move from the connecting position to the non-connecting position.

In the valve mechanism described in Japanese Patent Laid-Open No. 2009-264199, to cancel the connected state between the first rocker arm and the second rocker arm, first, the oil pressure applied to the slide pin located at the connecting position is canceled. In a case in which the driving force is transmitted from the first rocker arm to the second rocker arm, and the above-described frictional force is relatively large, the slide pin does not move even if the oil pressure is canceled. However, there is a time when the frictional force becomes small depending on a condition in which the two rocker arms swing. This time is, for example, the time when the intake valve or the exhaust valve lifts a little. In this case, since the reaction of the valve spring is small, the frictional force is small too. In addition, at the time when the intake valve or the exhaust valve is close to the maximum lift, the frictional force becomes small because a negative acceleration acts on the rocker arms. When the frictional force decreases, and the slide pin becomes movable by the spring force of the return spring, the slide pin moves from the connecting position to the non-connecting position.

In the driving device disclosed in Japanese Patent Laid-Open No. 2009-264199, a so-called "flip phenomenon" may occur in the process of canceling the connected state between the first rocker arm and the second rocker arm and in the process of shifting from the non-connected state to the connected state. The flip phenomenon is a phenomenon in which the connected state between the two rocker arms is canceled in a state in which the intake valve or the exhaust valve is not closed, and the second rocker arm and the intake valve or the exhaust valve are abruptly returned to the closing position by the spring force of the valve spring.

Two causes are considered to bring about the flip phenomenon, as will be described below. As the first cause, when the rocker arms shift from the non-connected state to the connected state, the rocker arms swing in a state in which the slide pin is insufficiently fitted. The slide pin is insufficiently fitted because the rocker arms are sometimes pressed by the cams and start swinging when the slide pin is slightly fitted in the rocker arms. If the rocker arms start swinging in the state in which the slide pin is insufficiently fitted, a load is applied to the slide pin fitting portion in a state in which the intake valve or the exhaust valve is open. When the fitting of the slide pin comes off due to the load, the flip phenomenon occurs.

As the second cause, probably, when the rocker arms shift from the connected state to the non-connected state, and the intake valve or the exhaust valve is open, the frictional force acting on the slide pin becomes small, and the fitting of the slide pin comes off due to the spring force of the return spring.

When the flip phenomenon occurs, an impact load is applied to the second rocker arm and the intake valve or the exhaust valve. If the flip phenomenon frequently occurs, the second rocker arm and the intake valve or the exhaust valve may be damaged.

For this reason, in the conventional valve mechanism in this type of engine, a transmission component such as the above-described slide pin is required to operate in a predetermined operation amount at a predetermined time and prevent the above-described flip phenomenon from occurring.

SUMMARY OF THE INVENTION

Preferred embodiments of the present invention provide valve mechanisms for an engine in which a transmission that switches a driving state of an intake valve or an exhaust valve reliably operates only in a predetermined operation amount at an appropriate time, and a flip phenomenon does not occur.

According to a preferred embodiment of the present invention, a valve mechanism for an engine includes a camshaft including a valve driving cam that drives one of an intake valve and an exhaust valve, a rocker arm that converts a rotation of the valve driving cam into a reciprocal motion and transmits the reciprocal motion to one of the intake valve and the exhaust valve, a synchronization cam that rotates in synchronism with the valve driving cam, and a switch assembly that includes a cam follower that is pressed and moved by the synchronization cam, and that switches, when the cam follower is pressed by the synchronization cam, a driving state of one of the intake valve and the exhaust valve to a predetermined first driving state or a predetermined second driving state, wherein the synchronization cam presses the cam follower at a time when one of the intake valve and the exhaust valve is closed, the switch assembly includes a switch unit that switches the driving state when a switch moves, a driver including a transmission that transmits a motion of the cam follower to the switch, and drives the switch via the transmission in a direction to switch the driving state, and a positioner that includes a spring-biased presser that engages with a concave portion in the transmission, and positions the transmission at a predetermined position defined by the concave portion, the concave portion includes a first concave portion with which the presser engages when the transmission moves to a position in the first driving state, and a second concave portion with which the presser engages when the transmission moves to a position in the second driving state, and a positioning interval between the first concave portion and the second concave portion is greater than a moving amount of the transmission when the transmission is driven and moved by the synchronization cam.

In a valve mechanism according to a preferred embodiment of the present invention, the synchronization cam presses the cam follower at a time when the intake valve or the exhaust valve is closed, and the transmission is thus driven and moved. At this time, along with the movement of the transmission, the first concave portion and the second concave portion move with respect to the presser. The operation of the synchronization cam to press the cam follower ends halfway through the engagement of the presser with the first or second concave portion. For this reason, the synchronization cam stops pressing the cam follower halfway through the time when the presser is pressing a portion on the side of the opening edge of the first or second concave portion by the spring force of the spring.

When the presser thus presses a portion on the side of the opening edge of the first or second concave portion, a thrust that further presses the transmission ahead in the moving direction acts on the transmission. As a result, after the operation of the synchronization cam to press the cam follower ends, the transmission is pressed by the above-described thrust and further advances. When the presser completely engages with the first or second concave portion, the transmission is located at a position defined by the first or second concave portion.

When the transmission is positioned in this manner, the driving state of the intake valve or the exhaust valve is switched to one of the first driving state and the second driving state.

Hence, according to preferred embodiments of the present invention, it is possible to provide a valve mechanism in which a flip phenomenon does not occur since the transmission that changes the driving state reliably operates only in a predetermined operation amount at an appropriate time.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

A valve mechanism for an engine according to a preferred embodiment of the present invention will now be described in detail with reference to FIGS. 1 to 18.

Figure 1:
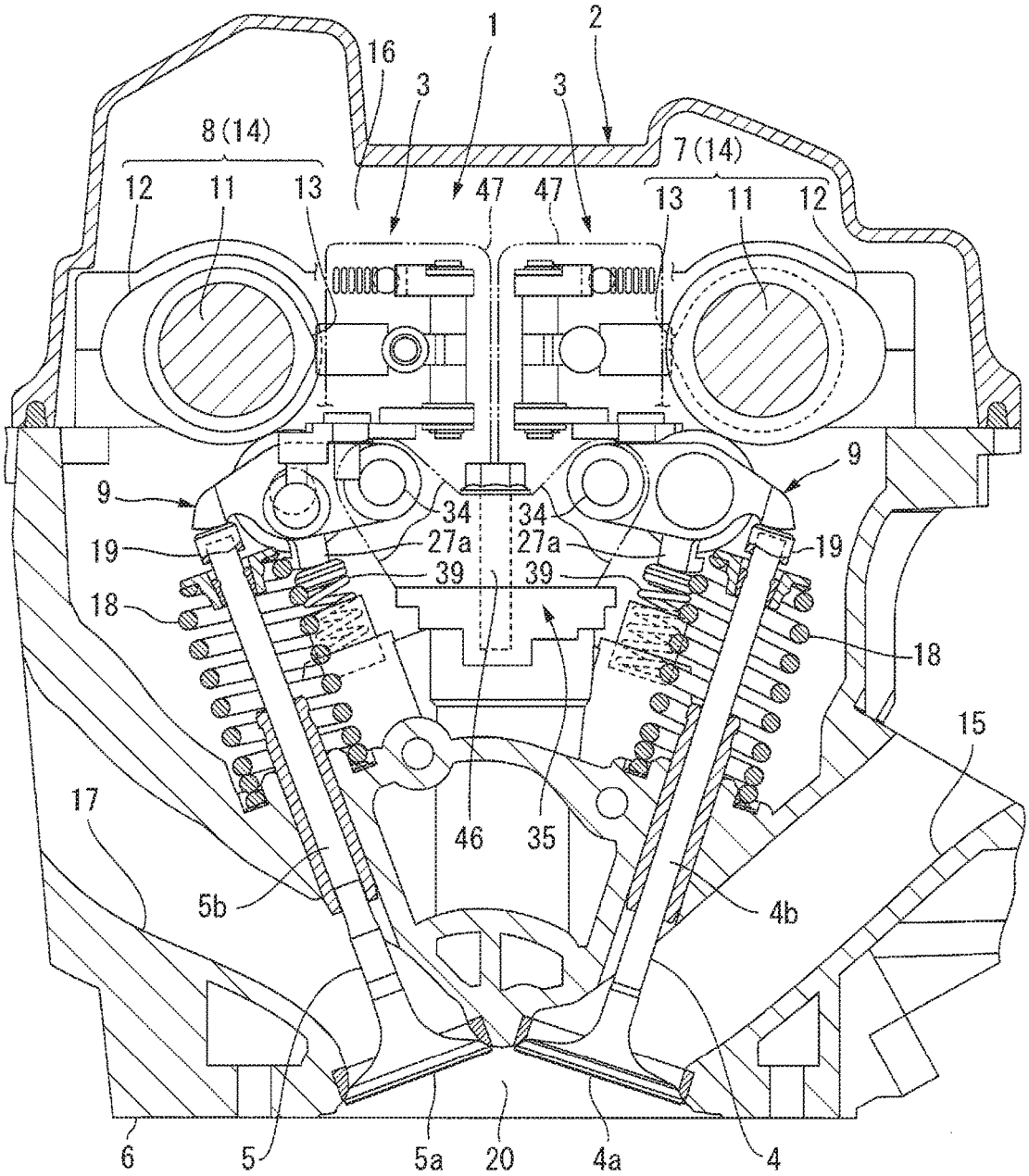
FIG. 1 is a sectional view of a valve mechanism for an engine according to a first preferred embodiment of the present invention.

A valve mechanism 1 shown in FIG. 1 is provided in, for example, a DOHC-type four-cylinder engine 2 mounted in a vehicle (not shown). The valve mechanism 1 includes switch assemblies 3 that switch between a full cylinder operation state in which four cylinders are operated as usual and a partial cylinder operation state (deactivated state) in which two cylinders of the four cylinders are deactivated.

The switch assemblies 3 are provided for the two cylinders of the four cylinders, as will be described below in detail. For example, the switch assemblies 3 may be provided for the first cylinder and the fourth cylinder which are located at the two ends of a cylinder train, or for the second cylinder and the third cylinder which are located at the center of the cylinder train.

As shown in FIG. 1, the switch assemblies 3 according to this preferred embodiment define a portion of the valve mechanism 1 and are respectively provided on one side where an intake valve 4 is located and on the other side where an exhaust valve 5 is located. In the above-described operation states, the valve mechanism 1 converts the rotations of an intake camshaft 7 and an exhaust camshaft 8 provided in a cylinder head 6 into reciprocal motions by rocker arms 9 and drives the intake valves 4 and the exhaust valves 5.

In the valve mechanism 1, a portion that drives the intake valves 4 and a portion that drives the exhaust valves 5 preferably have the same structure. For this reason, as for elements with the same structure on the side of the intake valves 4 and the side of the exhaust valves 5, the elements on the side of the exhaust valves 5 will be described below. The elements on the side of the intake valves 4 are denoted by the same reference numerals as those on the side of the exhaust valves 5, and a description thereof will be omitted.

Each of the intake camshaft 7 and the exhaust camshaft 8 includes a camshaft main body 11 rotatably supported in the cylinder head 6, and valve driving cams 12 and synchronization cams 13 which are provided on the camshaft main body 11. Note that the intake camshaft 7 and the exhaust camshaft 8 will simply be referred to as camshafts 14 in general hereinafter.

Figure 5:
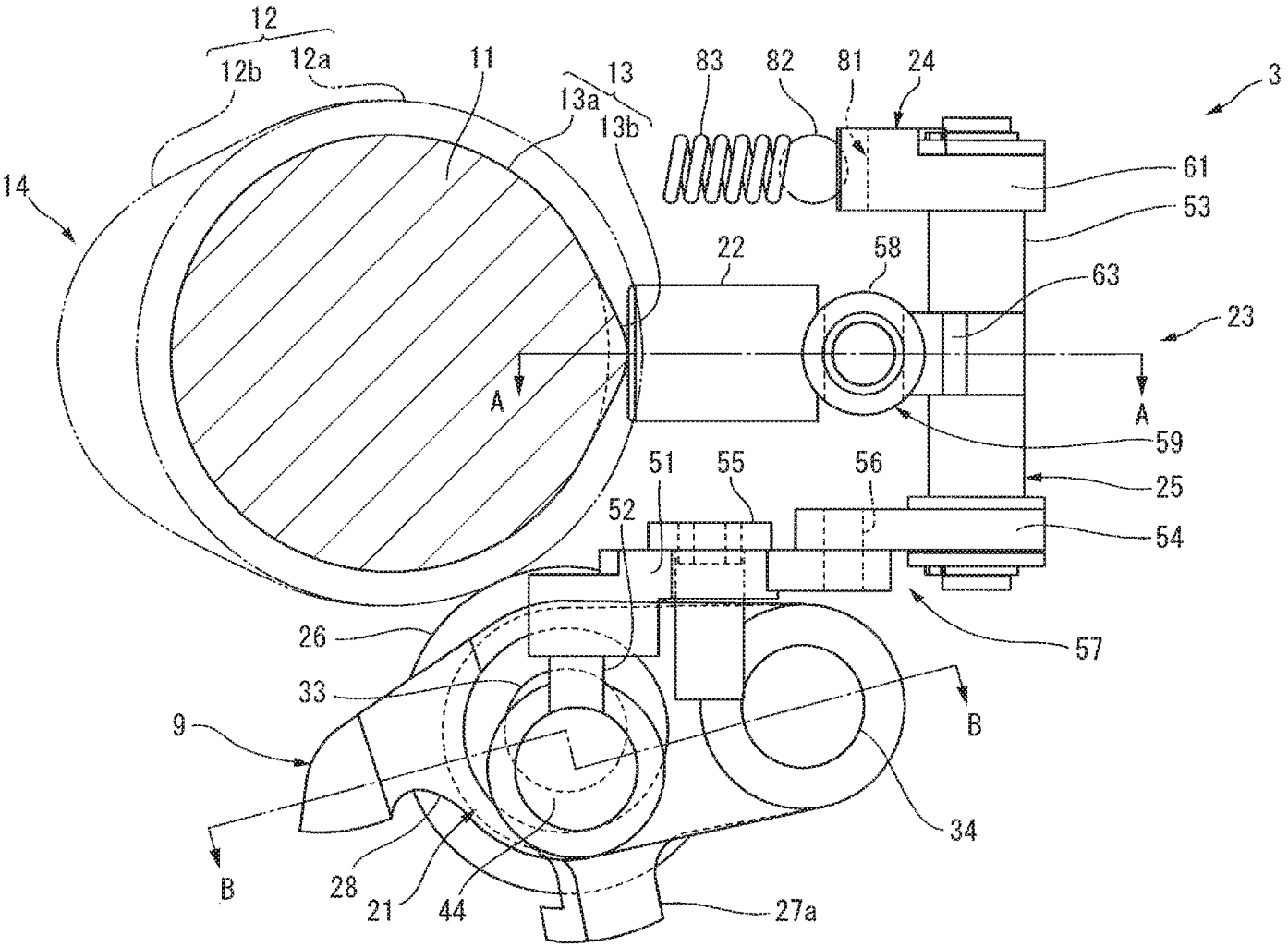
FIG. 5 is a side view of the main elements of the valve mechanism.

The camshaft main body 11 has an elongated rod shape with a circular cross-section. As shown in FIG. 5, the valve driving cam 12 includes a base circle portion 12*a* and a nose portion 12*b*. The base circle portion 12*a* has a shape that defines a portion of a column located on the same axis as the camshaft main body 11, and has a size that sets the valve lift amount of the intake valve 4 or the exhaust valve 5 to zero. The nose portion 12*b* has a shape that projects, by a predetermined projection amount, from the base circle portion 12*a* outward in the radial direction so as to have a mountain-shaped cross-section.

The synchronization cam 13 defines the time when the switch assembly 3 performs a switching operation and powers the switch assembly 3. As shown in FIG. 5, the synchronization cam 13 includes a base circle portion 13*a* and a nose portion 13*b*, and is provided at a position adjacent to the valve driving cam 12. The synchronization cam 13 rotates in synchronism with the valve driving cam 12. The base circle portion 13*a* of the synchronization cam 13 has a shape that defines a portion of a column located on the same axis as the camshaft main body 11. The nose portion 13*b* of the synchronization cam 13 has a shape that projects, by a predetermined projection amount, from the base circle portion 13*a* outward in the radial direction so as to have a mountain-shaped cross-section.

The positional relationship between the valve driving cam 12 and the synchronization cam 13 with respect to the rotation direction of the camshaft 14 is set such that the switch assembly 3 is operated by the synchronization cam 13 at the time when the valve driving cam 12 closes the intake valve 4 or the exhaust valve 5. That is, when the camshaft main body 11 is viewed from the axial direction, as shown in FIG. 5, the positional relationship is set such that the switch assembly 3 is operated by the nose portion 13*b* at any timing during the period when the base circle portion 12*a* of the valve driving cam 12 is in contact with the rocker arm 9.

Two intake valves 4 and two exhaust valves 5 are preferably provided in each cylinder and are movably supported in the cylinder head 6. The two intake valves 4 are located at a predetermined interval in the axial direction of the intake camshaft 7. The two exhaust valves 5 are located at a predetermined interval in the axial direction of the exhaust camshaft 8.

Each intake valve 4 includes a valve body 4*a* that opens/closes an intake port 15 of the cylinder head 6, and a valve stem 4*b* extending from the valve body 4*a* into a valve chamber 16 of the cylinder head 6. Each exhaust valve 5 includes a valve body 5*a* that opens/closes an exhaust port 17 of the cylinder head 6, and a valve stem 5*b* extending from the valve body 5*a* into the valve chamber 16 of the cylinder head 6. A valve spring 18 that biases the intake valve 4 or the exhaust valve 5 in a closing direction is provided between the cylinder head 6 and each of the distal ends of the valve stems 4*b* and 5*b*. A cap-shaped shim 19 is provided at each of the distal ends of the valve stems 4*b* and 5*b*.

The upstream end of the intake port 15 is open to one side of the cylinder head 6. The downstream end of the intake port 15 is open to a combustion chamber 20 of each cylinder. The upstream end of the exhaust port 17 is open to the combustion chamber 20. The downstream end of the exhaust port 17 is open to the other side of the cylinder head 6. A spark plug (not shown) is provided at the center of the combustion chamber 20.

Figure 4:
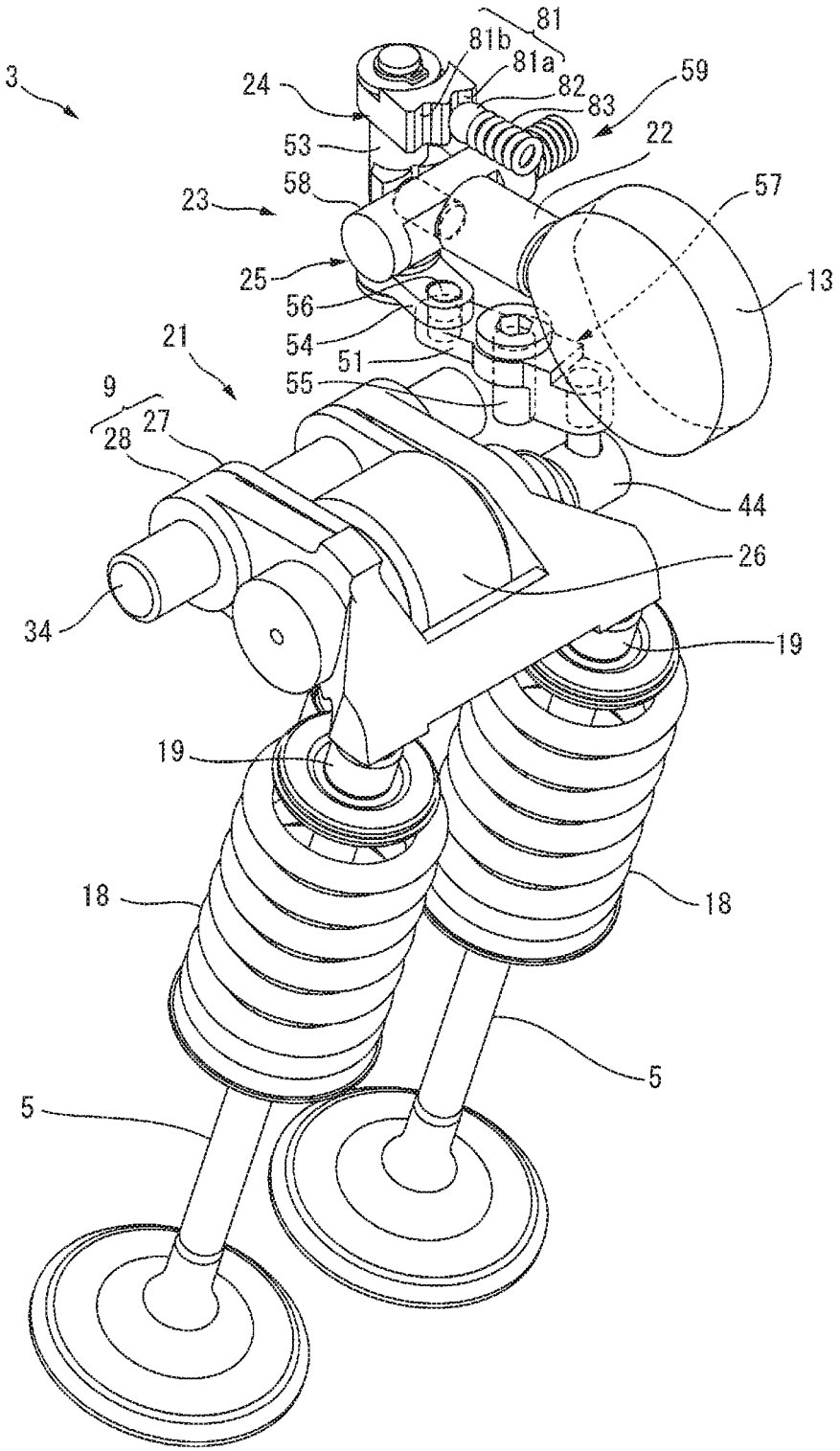
FIG. 4 is a perspective view of the main elements of the valve mechanism.

As shown in FIG. 4, the switch assembly 3 according to this preferred embodiment includes a switch unit 21 including the rocker arm 9 that drives the intake valves 4 or the exhaust valves 5, a driver 23 including a cam follower 22 that is pressed and moved by the above-described synchronization cam 13, a positioner 24 located at the uppermost position in FIG. 4, and the like.

The switch unit 21 switches the driving state of the intake valves 4 or the exhaust valves 5 by moving a switch 21A (see FIG. 6) that is one of the elements of a valve mechanism system to be described below. The driver 23 includes a transmission 25 defined by a plurality of elements located between the cam follower 22 and the rocker arm 9, as will be described below in detail. The transmission 25 transmits the motion of the cam follower 22. The driver 23 drives the switch 21A that is also one of a plurality of elements of the valve mechanism system in a direction to switch the driving state via the transmission 25.

Figure 2:
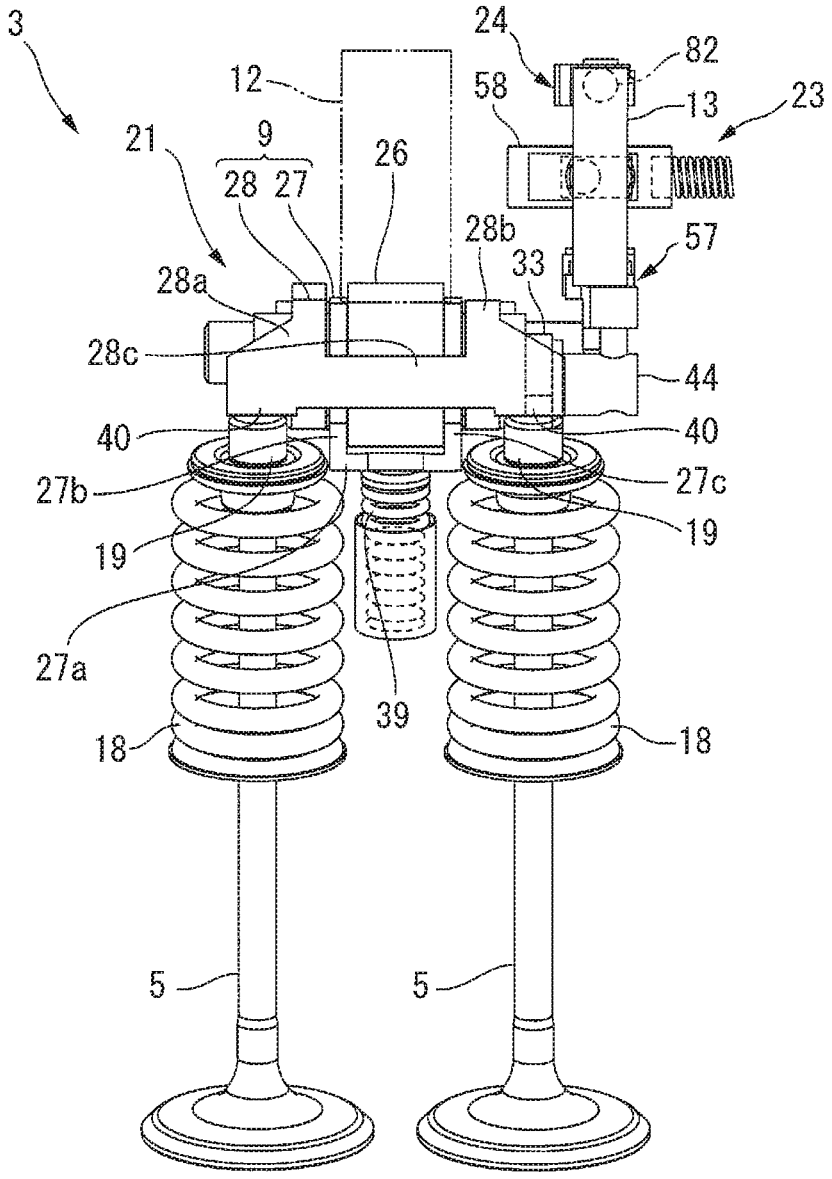
FIG. 2 is a front view of the main elements of the valve mechanism.
Figure 3:
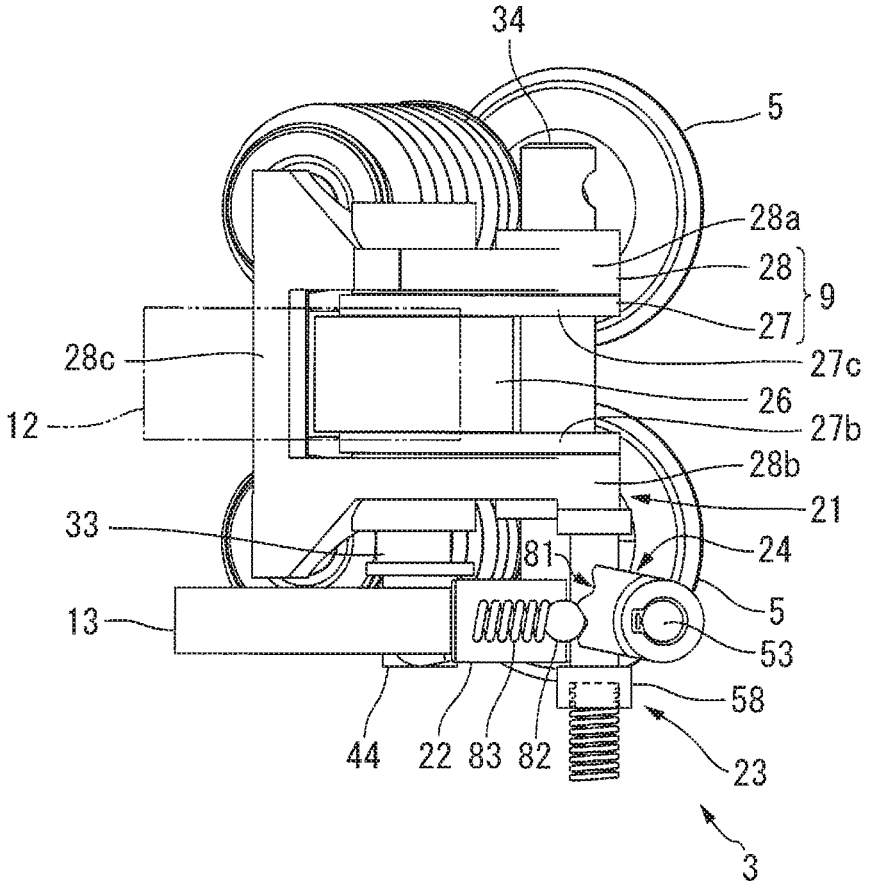
FIG. 3 is a plan view of the main elements of the valve mechanism.

As shown in FIGS. 2 to 4, the rocker arm 9 includes a plurality of elements. The plurality of elements include a first rocker arm 27 including a roller 26 in contact with the valve driving cam 12, a second rocker arm 28 located at a position adjacent to the first rocker arm 27 in the axial direction of the camshaft 14, first to third switching pins 31 to 33 (see FIGS. 6 and 7) that selectively connect the first rocker arm 27 and the second rocker arm 28, and the like.

Figure 6:
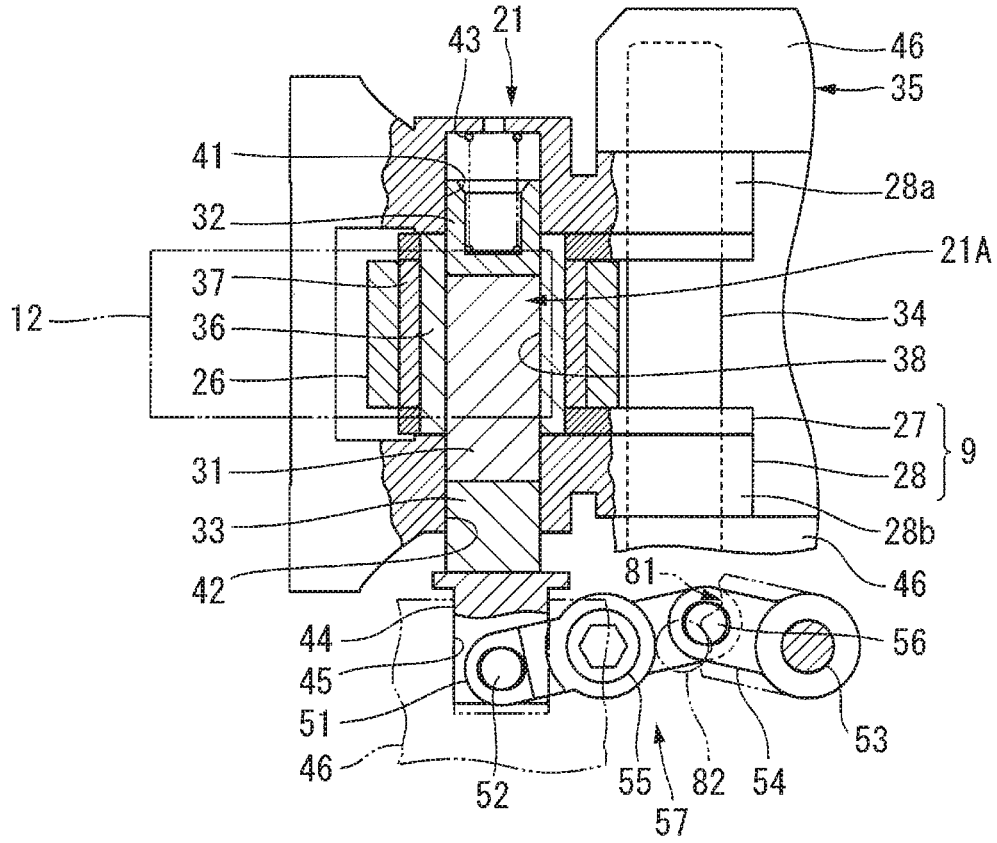
FIG. 6 is a sectional view of rocker arms, which shows a connected state in which a first rocker arm and a second rocker arm are connected.
Figure 7:
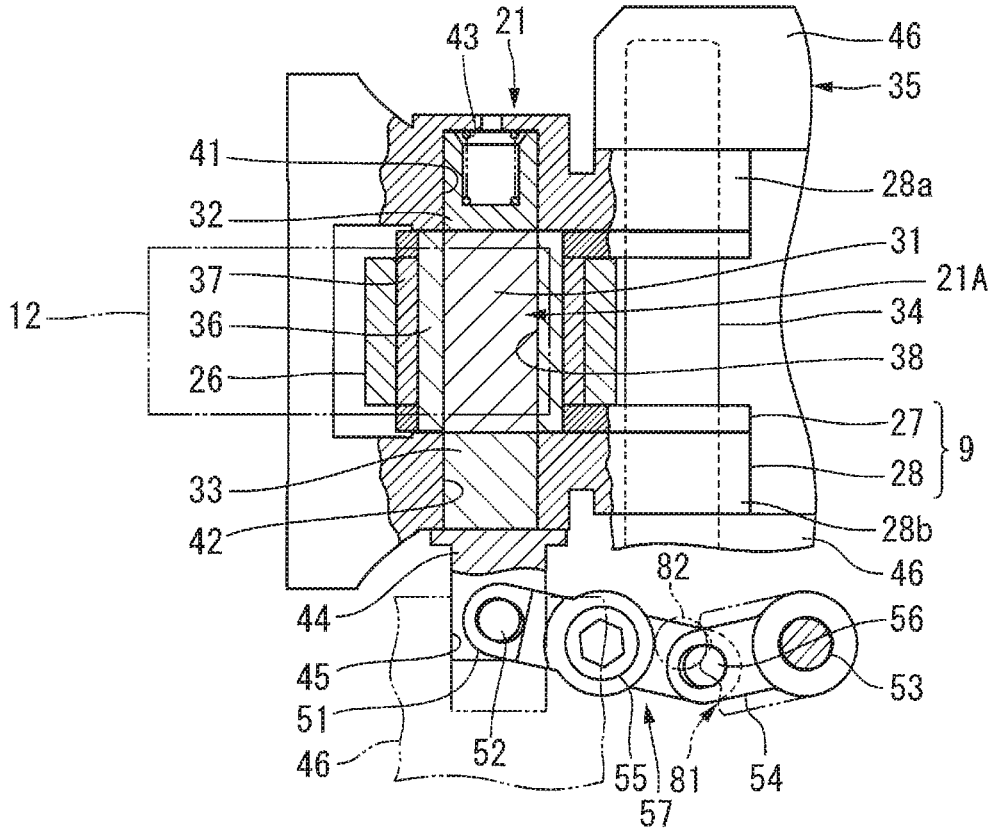
FIG. 7 is a sectional view of the rocker arms, which shows a non-connected state in which the first rocker arm and the second rocker arm are not connected.

As shown in FIGS. 1 to 5, the first rocker arm 27 includes a right-side arm portion 27*b* and a left-side arm portion 27*c*, which are connected by a connecting portion 27*a* (see FIG. 5) to define a U shape (see FIG. 2) in a front view. One end of the first rocker arm 27 is swingably supported by a rocker shaft 34. The rocker shaft 34 is attached to a support 35 (see FIG. 1) fixed to the cylinder head 6 in a state in which the rocker shaft 34 is parallel or substantially parallel to the camshaft 14. A swing end of the first rocker arm 27 includes a tubular shaft 36, as shown in FIGS. 6 and 7, and supports the roller 26 via the tubular shaft 36. The axis of the tubular shaft 36 is parallel or substantially parallel to the axis of the rocker shaft 34. The roller 26 is rotatably supported on the tubular shaft 36 by a bearing 37.

The hollow portion of the tubular shaft 36 extends in the axial direction of the camshaft 14 so as to cross the first rocker arm 27. The first switching pin 31 is movably fitted in the hollow portion. The hollow portion of the tubular shaft 36 will be referred to as a first pin hole 38 hereinafter. In this preferred embodiment, the length of the first switching pin 31 equals the length of the first pin hole 38. However, the length of the first switching pin 31 may be larger or smaller than that of the first pin hole 38 as long as the first switching pin 31 is able to avoid fitting in an adjacent pin hole in a non-connected state to be described below.

As shown in FIGS. 1 and 2, a return spring 39 is provided between the cylinder head 6 and the connecting portion 27*a* that connects the right-side arm portion 27*b* and the left-side arm portion 27*c* to define a U shape in the front view at a swing end of the first rocker arm 27. The spring 39 biases the first rocker arm 27 in a direction in which the roller 26 is pressed against the valve driving cam 12. For this reason, the first rocker arm 27 is pressed by the valve driving cam 12, thus swinging against the spring force of the spring 39.

As shown in FIG. 3, the second rocker arm 28 includes a first arm main body 28*a* and a second arm main body 28*b*, which are located on both sides of the first rocker arm 27, and a connecting portion 28*c* that connects swing ends of the first arm main body 28*a* and the second arm main body 28*b*. First ends of the first arm main body 28*a* and the second arm main body 28*b* are swingably supported by the rocker shaft 34. As shown in FIG. 2, the connecting portion 28*c* extends in the axial direction of the camshaft 14. Pressing portions 40 that press the shims 19 of the intake valves 4 or the exhaust valves 5 are located at the two ends of the connecting portion 28*c* in the longitudinal direction. The second rocker arm 28 simultaneously presses the two intake valves 4 or exhaust valves 5 of each cylinder.

As shown in FIGS. 6 and 7, a second pin hole 41 is located in the intermediate portion of the first arm main body 28*a*. A third pin hole 42 is located in the intermediate portion of the second arm main body 28*b*. The second pin hole 41 and the third pin hole 42 extend in the axial direction of the camshaft 14 so as to cross the first arm main body 28*a* and the second arm main body 28*b*. The distance between the center line of the second pin hole 41 and the third pin hole 42 and the axis of the rocker shaft 34 matches the distance between the center line of the first pin hole 38 of the first rocker arm 27 and the axis of the rocker shaft 34. That is, the first pin hole 38 and the second pin hole 41 and the third pin hole 42 are located on the same axis in a state in which the swing angle of the first rocker arm 27 and the swing angle of the second rocker arm 28 are set to a predetermined angle. The predetermined angle is an angle obtained when the intake valves 4 or the exhaust valves 5 are closed. For this reason, the second pin hole 41 and the third pin hole 42 are located on the same axis as the first pin hole 38 when the valve lift amount of the intake valves 4 or the exhaust valves 5 becomes zero.

The hole diameters of the second pin hole 41 and the third pin hole 42 match the hole diameter of the first pin hole 38. The second switching pin 32 is movably fitted in the second pin hole 41, and the second pin hole 41 is provided with a spring 43 that biases the second switching pin 32 toward the first rocker arm 27.

The third switching pin 33 is movably fitted in the third pin hole 42. The length of the third switching pin 33 equals the length of the third pin hole 42. However, the length of the third switching pin 33 may be larger or smaller than that of the third pin hole 42 as long as the third switching pin 33 is able to avoid fitting in an adjacent pin hole in a non-connected state to be described later. The end of the third switching pin 33 on the opposite side of the first rocker arm 27 faces a pressing member 44 of the driver 23 to be described below. The driver 23 presses the third switching pin 33 toward the first rocker arm 27 using the pressing member 44.

When the first to third pin holes 38, 41, and 42 are arranged on the same axis in a state in which the pressing member 44 is not pressing the third switching pin 33, the first to third switching pins 31 to 33 are pressed by the spring force of the spring 43 and move to a connecting position, as shown in FIG. 6. The connecting position is a position where the first switching pin 31 and the second switching pin 32 are located across the first rocker arm 27 and the second rocker arm 28.

When the first switching pin 31 and the second switching pin 32 move to the connecting position, one end of the third switching pin 33 projects from the second arm main body 28*b* and abuts against the pressing member 44. When the first to third switching pins 31 to 33 move to the connecting position, the first rocker arm 27 and the second rocker arm 28 are connected and integrally swing together. That is, the rotation of the valve driving cam 12 is converted into a reciprocal motion by both the first rocker arm 27 and the second rocker arm 28, and the intake valves 4 or the exhaust valves 5 are driven. In this case, the cylinders including the switch assemblies 3 are set in an operation state. At this time, the third switching pin 33 moves with the swinging of the second rocker arm 28 in a state in which the third switching pin 33 is pressed against the pressing member 44.

On the other hand, when the pressing member 44 presses the third switching pin 33, the first switching pin 31 and the second switching pin 32 move to a non-connecting position where the first switching pin 31 and the second switching pin 32 are not located across the first rocker arm 27 and the second rocker arm 28, as shown in FIG. 7. When the first and second switching pins 31 and 32 move to the non-connecting position, the connected state between the first rocker arm 27 and the second rocker arm 28 is canceled. In this case, since the first rocker arm 27 and the second rocker arm 28 individually swing, only the first rocker arm 27 is pressed by the valve driving cam 12 and swings, and the second rocker arm 28 does not swing. For this reason, since the intake valves 4 or the exhaust valves 5 are kept in the closed state, the cylinders including the switch assembly 3 are in a deactivated state.

In this preferred embodiment, "the switch 21A that is one of elements of the valve mechanism system from the valve driving cam to the rocker arm" includes the first to third switching pins 31 to 33. Additionally, in this preferred embodiment, the operation state in which the first rocker arm 27 and the second rocker arm 28 are connected is "the first driving state", and the operation state in which the connected state between the first rocker arm 27 and the second rocker arm 28 is canceled is "the second driving state".

As shown in FIGS. 6 and 7, the pressing member 44 has a columnar shape and is movably fitted in a shaft hole 45 of the support 35 fixed to the cylinder head 6. As shown in FIG. 1, the support 35 includes a base portion 46 that supports the rocker shaft 34, and driver housings 47 projecting from the base portion 46. The driver housings 47 are molded integrally with the base portion 46, or are elements separate from the base portion 46 and attached to the base portion 46. The shaft hole 45 is provided in the base portion 46.

One end of the pressing member 44, which faces the third switching pin 33, has a disc shape and a predetermined size. The end surface of the one end, which faces the third switching pin 33, is flat such that the third switching pin 33 is able to swing integrally with the second arm main body 28*b* in a state in which the third switching pin 33 is in contact with the end face. The one end has a size that makes the one end always face the third switching pin 33 that swings integrally with the second arm main body 28*b*.

A connecting lever 51 (to be described below) of the driver 23 is pivotally connected to the pressing member 44 via a first connecting pin 52. When the connecting lever 51 swings, the pressing member 44 advances or retreats with respect to the second arm main body 28*b*. For this reason, the pressing member 44 reciprocally moves between an advance position shown in FIG. 7 and a retreat position shown in FIG. 6.

Figure 12:
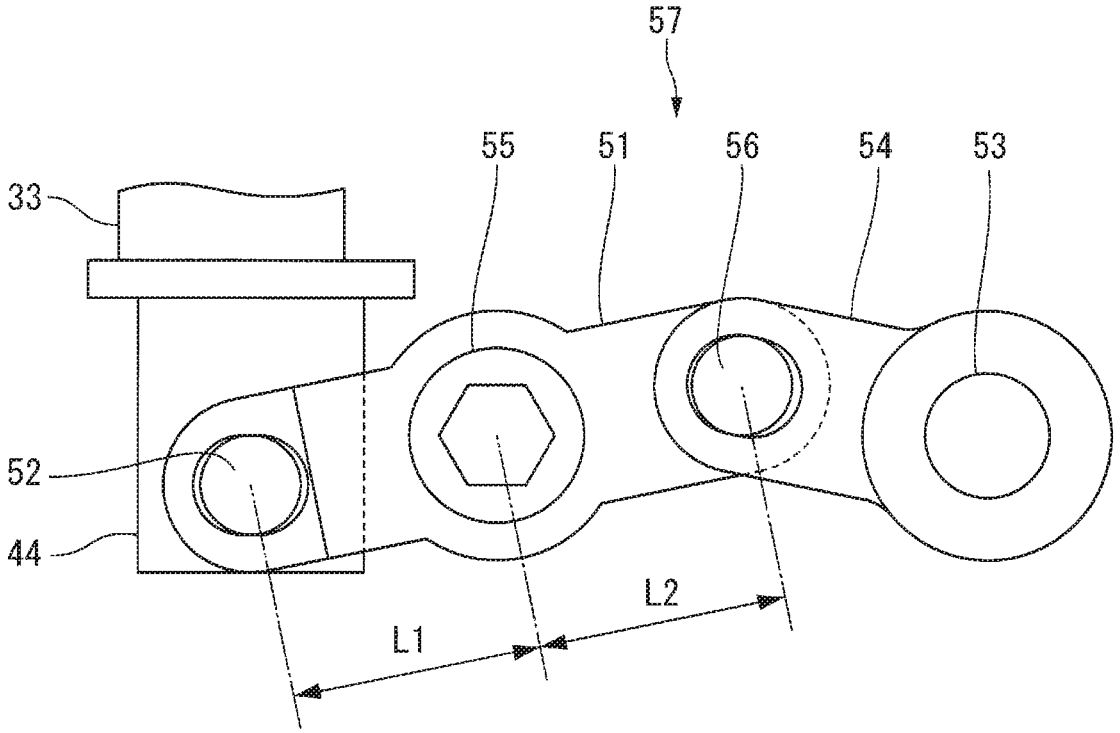
FIG. 12 is a plan view for explaining the structure of a connecting lever.

The connecting lever 51, which is connected to the pressing member 44, is connected to one end of a pivot shaft 53 to be described below via a driving lever 54. As shown in FIG. 12, the connecting lever 51 is pivotally supported on the base portion 46 (not shown) by a support shaft 55. The support shaft 55 extends through the center of the connecting lever 51 in the longitudinal direction and is fixed to the base portion 46. The axis of the support shaft 55 is parallel or substantially parallel to the axis of the pivot shaft 53.

One end of the connecting lever 51 is pivotally connected to the pressing member 44 by the first connecting pin 52. For this reason, the above-described "switch 21A" (third switching pin 33) is operated by the connecting lever 51 via the pressing member 44.

The other end of the connecting lever 51 is pivotally connected to the pivotal end of the driving lever 54 by a second connecting pin 56. The driving lever 54 is fixed to the pivot shaft 53. The axes of the first connecting pin 52 and the second connecting pin 56 are parallel or substantially parallel to the axes of the pivot shaft 53 and the support shaft 55.

In FIG. 12, a length L1 of the connecting lever 51 on one end side is the same as a length L2 on the other end side. However, the operation amount of the connecting lever 51 is able to be changed by changing the ratio of the lengths L1 and L2. The length L1 is the distance between the axis of the support shaft 55 and the axis of the first connecting pin 52. The length L2 is the distance between the axis of the support shaft 55 and the axis of the second connecting pin 56.

Since the pivot shaft 53 is connected to the pressing member 44 via the connecting lever 51 and the driving lever 54 in this manner, when the pivot shaft 53 pivots, the motion of the pivot shaft 53 is transmitted to the pressing member 44. This will be described in detail. When the pivot shaft 53 pivots, the driving lever 54 and the connecting lever 51 swing in synchronism with the pivotal operation of the pivot shaft 53, and the pressing member 44 moves in the axial direction of the camshaft 14 to the advance position or the retreat position. That is, the pivotal motion of the pivot shaft 53 is converted into a reciprocal motion by the driving lever 54 and the connecting lever 51 and transmitted to the above-described "switch 21A" (third switching pin 33). In this preferred embodiment, a converter 57 includes the connecting lever 51, the driving lever 54, the above-described pressing member 44, and the like.

The pivot shaft 53 defines a portion of the driver 23. The driver 23 according to this preferred embodiment includes the combination of a plurality of elements including the pivot shaft 53, and is provided at a position adjacent to the rocker arm 9 in the axial direction of the rocker shaft 34, as shown in FIGS. 3 and 4. For the driver 23 shown in FIGS. 2 to 5, only elements that operate are illustrated for easier understanding of the driver 23.

As shown in FIG. 5, the driver 23 includes the pivot shaft 53 whose one end (the lower end in FIG. 5) is provided with the above-described driving lever 54, an inverter 59 including a moving member 58 located between the pivot shaft 53 and the cam follower 22, the converter 57 including the driving lever 54, and the like.

The pivot shaft 53 is pivotally supported by a housing 47 in a state in which the pivot shaft 53 extends in a direction (the vertical direction in FIG. 5) perpendicular or substantially perpendicular to both the axial direction (a direction perpendicular to the sheet surface in FIG. 5) of the camshaft 14 and the moving direction (the horizontal direction in FIG. 5) of the cam follower 22. The moving direction of the cam follower 22 will simply be referred to as a "first direction", and the axial direction of the camshaft 14 will simply be referred to as a "second direction" hereinafter. The pivot shaft 53 is located at a position where it faces the cam surface of the synchronization cam 13. A concave member 61 of the positioner 24 to be described below is provided at the other end (the upper end in FIG. 5) of the pivot shaft 53.

Figure 8:
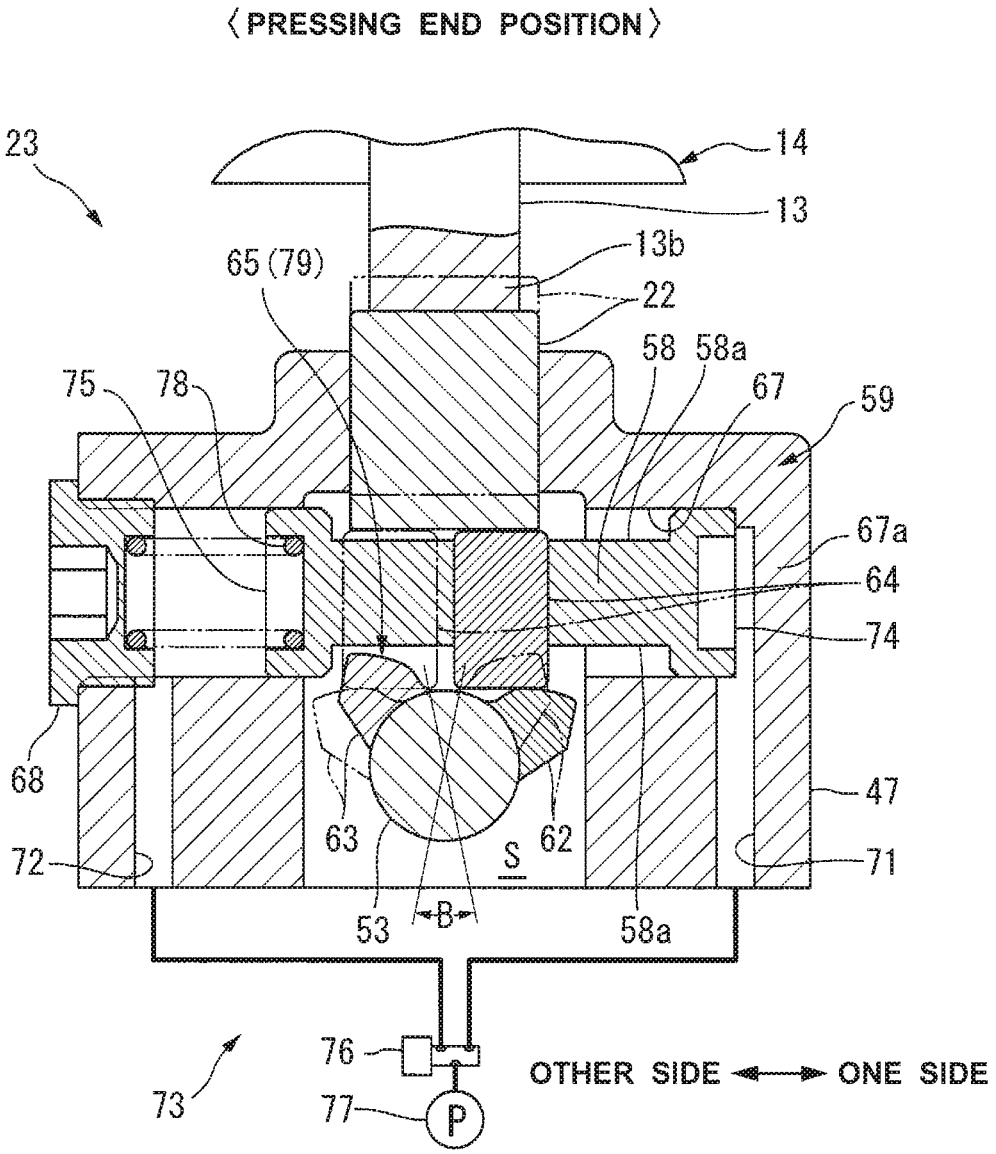
FIG. 8 is a sectional view of a driver taken along a line A-A in FIG. 5.

As shown in FIG. 8, a first projection 62 and a second projection 63 are provided at the intermediate portion of the pivot shaft 53 in the axial direction. The first projection 62 projects from the pivot shaft 53 to one side perpendicular or substantially perpendicular to the axial direction. The second projection 63 projects from the pivot shaft 53 in a direction opposite to the first projection 62.

Figure 10:
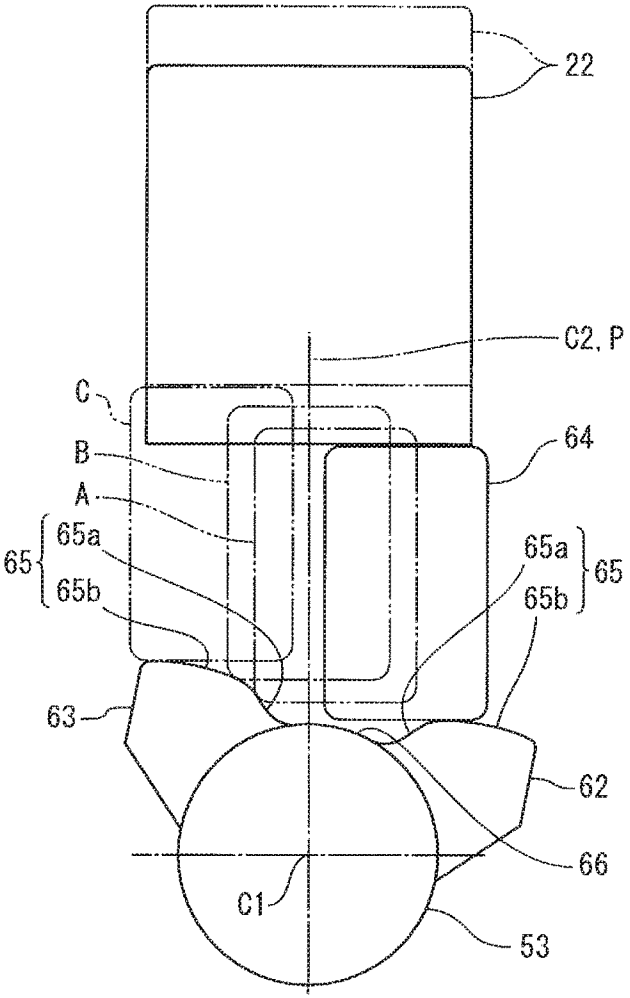
FIG. 10 is an enlarged sectional view of the main elements of the driver.

The pivot shaft 53 is attached to the housing 47 in a state in which the first projection 62 and the second projection 63 extend in the axial direction of the camshaft 14. The first projection 62 and the second projection 63 are housed in a space S in the housing 47. A side surface of each of the first projection 62 and the second projection 63, which faces the camshaft 14, defines a cam surface 65 that comes into contact with a slide pin 64 to be described below. As shown in FIG. 10, the cam surface 65 includes a steep slope portion 65*a* and a gentle slope portion 65*b*. The steep slope portion 65*a* is located on the proximal end side of each of the first and second projections 62 and 63. The gentle slope portion 65*b* is located on the projecting end side of each of the first and second projections 62 and 63.

Figure 11:
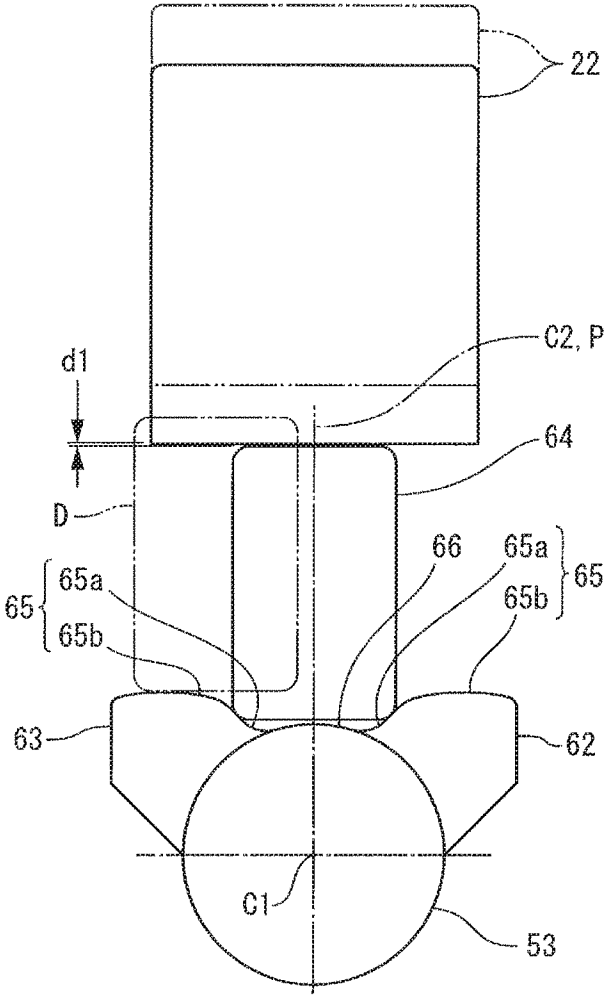
FIG. 11 is an enlarged sectional view of the main elements of the driver.

As shown in FIG. 11, the steep slope portion 65*a* of the first projection 62 and the steep slope portion 65*a* of the second projection 63 define the inner wall of a concave portion 66 that houses the slide pin 64 to be described below. The concave portion 66 includes the two steep slope portions 65*a* and a portion of the pivot shaft 53. Referring to FIG. 11, an axis C1 of the pivot shaft 53 and an axis C2 of the slide pin 64 are located on a single plane P. In the state shown in FIG. 11, the first projection 62 and the second projection 63 are located at positions almost symmetric with respect to the plane P. Additionally, in FIGS. 10 and 11, the cam follower 22 is illustrated by a solid line and an alternate long and two short dashed line. The solid line indicates the cam follower 22 that is pressed by the synchronization cam 13 and stops at a pressing end position. The alternate long and two short dashed line indicates the cam follower 22 that stops at a pressing start position before it is pressed by the synchronization cam 13.

As shown in FIG. 8, the cam follower 22, the moving member 58, and the slide pin 64 are provided between the first projection 62 and the second projection 63 and the synchronization cam 13.

The cam follower 22 has a columnar shape and is supported by the housing 47 to be movable in the first direction to move closer to or away from the axis of the camshaft 14.

The cam follower 22 reciprocally moves between the pressing start position (see FIGS. 13 and 17) where one end surface (an end surface facing the synchronization cam 13) is pressed by the nose portion 13*b* of the synchronization cam 13 and the pressing end position (see FIGS. 8 and 15) where the pressing by the synchronization cam 13 ends. The time when the nose portion 13*b* of the synchronization cam 13 presses the cam follower 22 is the time when the roller 26 of the first rocker arm 27 contacts the base circle portion 12*a* of the valve driving cam 12 (the time when the intake valves 4 or the exhaust valves 5 are closed). In other words, this is the time when the driving force to drive the intake valves 4 or the exhaust valves 5 is not transmitted to the first to third switching pins 31 to 33 of the switch assembly 3.

As shown FIG. 8, the moving member 58 located between the cam follower 22 and the first projection 62 and the second projection 63 has a columnar shape extending along the above-described second direction (the horizontal direction in FIG. 8), and supported by the housing 47 to be movable in the second direction. The above-described pivot shaft 53 is located at a position facing the cam follower 22 across the moving member 58 and supported by the housing 47 to be pivotal about an axis extending in a direction perpendicular or substantially perpendicular to the first direction and the second direction.

A cylinder hole 67 that is a non-through hole extending in the second direction from one side portion of the housing 47 is provided in the housing 47. The opening of the cylinder hole 67 is closed by a plug 68. The moving member 58 is slidably fitted in the cylinder hole 67. One end of the cam follower 22 faces the central portion of the cylinder hole 67 in the axial direction. In addition, the cylinder hole 67 communicates with the space S in which the first projection 62 and the second projection 63 are housed.

A first oil passage 71 is connected to a bottom portion 67*a* located at the deepest position in the cylinder hole 67. In addition, a second oil passage 72 is connected to the vicinity of the plug member 68 in the cylinder hole 67. The first and second oil passages 71 and 72 define a portion of an actuator 73 that drives the moving member 58.

The actuator 73 includes the inverter 59 together with the above-described moving member 58 and the slide pin 64.

The actuator 73 drives the moving member 58 by an oil pressure to one side or to the other side in the second direction. The actuator 73 according to this preferred embodiment includes first and second pistons 74 and 75 in the moving member 58, a switching valve 76 connected to the first and second oil passages 71 and 72, a hydraulic pump 77 that supplies an oil pressure to the switching valve 76, and the like. The first piston 74 is provided at one end of the moving member 58. The second piston 75 is provided at the other end of the moving member 58. The switching valve 76 is connected to the cylinder hole 67 via the first and second oil passages 71 and 72. The switching valve 76 is automatically or manually operated and switches between a state in which the oil pressure is supplied to the first piston 74 and a state in which the oil pressure is supplied to the second piston 75.

The hydraulic pump 77 is driven by the engine 2 or an electric motor (not shown) and discharges hydraulic oil.

Figure 13:
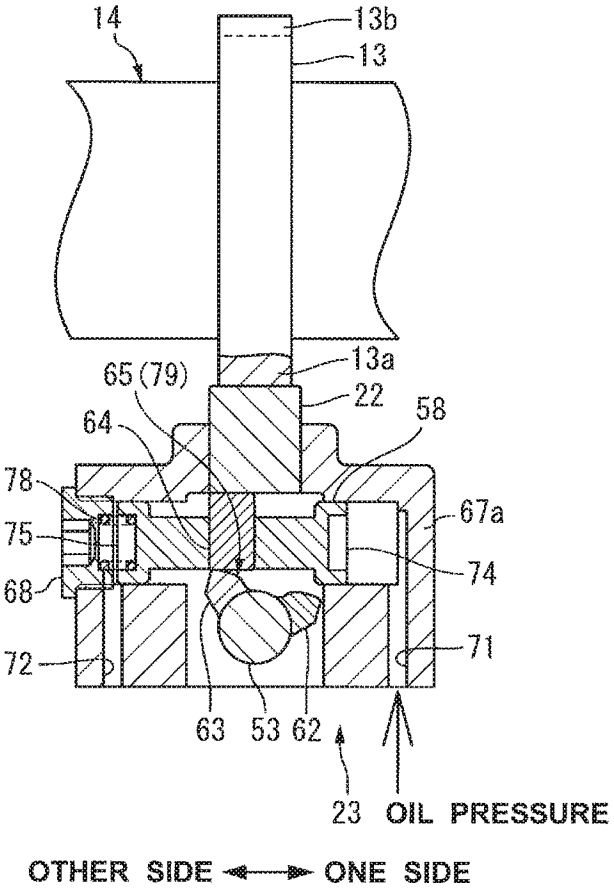
FIG. 13 is a sectional view of the driver taken along the line A-A in FIG. 5.
Figure 17:
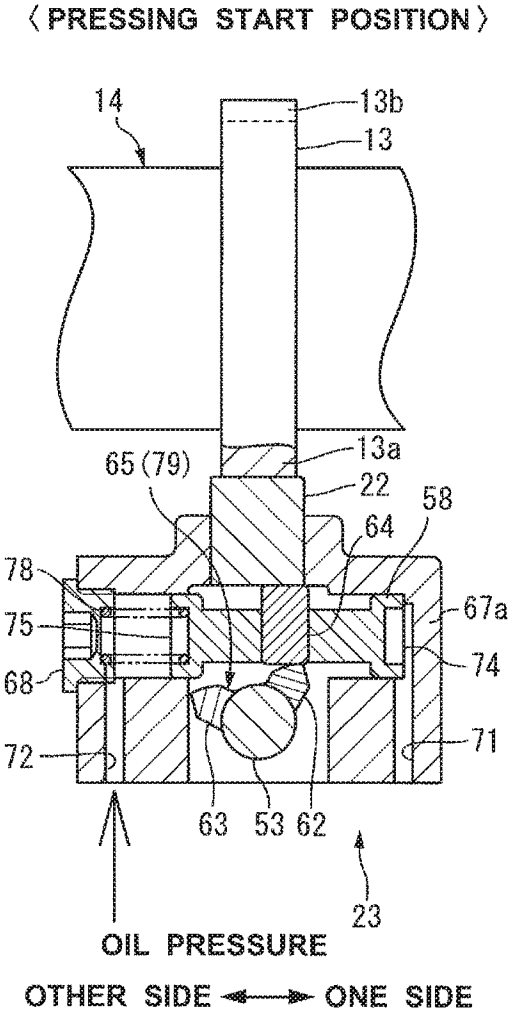
FIG. 17 is a sectional view of the driver taken along the line A-A in FIG. 5.

When the oil pressure is applied to the first piston 74, the moving member 58 moves to the side of the plug 68, as shown in FIG. 13. In addition, when the oil pressure is applied to the second piston 75, the moving member 58 moves to the side of the bottom portion 67*a* of the cylinder hole 67, as shown in FIG. 17. The time when the moving member 58 moves in the second direction in this manner is the time when the cam follower 22 faces the base circle portion 13*a* of the synchronization cam 13.

A compression coil spring 78 that biases the moving member 58 to one side of the second direction is provided between the second piston 75 and the plug member 68. The compression coil spring 78 is provided to avoid an uncontrollable state caused by shutoff of the oil pressure supply.

Two concave grooves 58*a* are provided at the central portion of the moving member 58 in the longitudinal direction, along with the slide pin 64 to be pressed by the cam follower 22. The concave grooves 58*a* extend by a predetermined length in the second direction in the outer peripheral portion of the moving member 58. The predetermined length is a length that allows the cam follower 22 to enter the concave groove 58*a* even if the moving member 58 is located at either of the terminating positions on the side of the bottom portion 67*a* and on the side of the plug member 68, as shown in FIGS. 8 and 13. The concave grooves 58*a* are located on one side and the other side in the radial direction of the moving member 58. The bottom surface of each concave groove 58*a* is preferably flat.

The slide pin 64 has a columnar shape that is thinner than the cam follower 22 and is supported by the moving member 58 to be movable in the first direction in a state in which the slide pin 64 extends through the central portion of the moving member 58 in the first direction. One end surface of the slide pin 64 always contacts the other end surface of the cam follower 22 when the moving member 58 moves from one end to the other end in the cylinder hole 67.

The moving member 58 moves to one side (to the side of the bottom portion 67*a* of the cylinder hole 67) of the second direction, such that the slide pin 64 is disposed between the cam follower 22 and the first projection 62. Additionally, the moving member 58 moves to the other side (to the side of the plug 68) of the second direction, as shown in FIG. 13, such that the slide pin 64 is disposed between the cam follower 22 and the second projection 63. When the cam follower 22 presses the slide pin 64 in a state in which the other end surface of the slide pin 64 faces the first projection 62 or the second projection 63, the first projection 62 or the second projection 63 is pressed by the slide pin 64. The length of the slide pin 64 is a length that makes the slide pin 64 press the first projection 62 or the second projection 63 in a direction to separate from the cam follower 22 when the cam follower 22 is pressed by the synchronization cam 13 and moves to the pressing end position.

For this reason, of the first projection 62 and the second projection 63, one projection (the first projection 62 indicated by a solid line in FIG. 8) that interposes the slide pin 64 between the one projection and the cam follower 22 receives a pressing force, via the slide pin 64, from the cam follower 22 pressed by the synchronization cam 13. The one projection that receives the pressing force rotates the pivot shaft 53 in the direction in which the one projection is pressed (clockwise in FIG. 8). For this reason, the pivot shaft 53 rotates when the pressing force is transmitted from the cam follower 22.

The first projection 62 and the second projection 63 swing like a seesaw about the pivot shaft 53. For this reason, one projection (the first projection 62 in FIG. 8) pressed by the slide pin 64 tilts in a direction in which its distal end separates from the cam follower 22. At this time, the other projection (the second projection 63 in FIG. 8) tilts in a direction in which its distal end approaches the cam follower 22.

That is, the other projection tilts so as to gradually approach the cam follower 22 from the pivot shaft 53 to the distal end. The other projection that tilts in this manner functions as a cam follower return cam 79 when the slide pin 64 that presses the one projection moves together with the moving member 58 in a direction (the direction in which the plug 68 is located in FIG. 8) to move toward the other projection. The cam follower return cam 79 presses the slide pin 64 toward the camshaft 14 together with the cam follower 22, thus returning the cam follower 22. When the other projection functions as the return cam 79, the slide pin 64 comes into contact with the above-described cam surface 65, and the moving direction of the slide pin 64 is changed. This means that the cam surface 65 substantially functions as the cam follower return cam 79.

When the moving member 58 moves, and the slide pin 64 is pressed by the above-described return cam 79, the slide pin 64 presses the cam follower 22 upward and returns it from the pressing end position to the pressing start position (see FIG. 13).

The time when the moving member 58 moves is the time when the slide pin 64 is not pressed by the cam follower 22. This is because when the slide pin 64 is pressed by the cam follower 22, the slide pin 64 cannot move to the side of the cam follower 22 along the above-described cam follower return cam 79. For this reason, the moving member 58 waits without moving until two conditions to be described below are satisfied, and moves after the two conditions are satisfied. As the first condition of the two conditions, the oil pressure is applied. As the second condition, the cam follower 22 faces the base circle portion 13*a* of the synchronization cam 13.

When the slide pin 64 presses the first projection 62 in a state in which the moving member 58 moves to one side (the side of the bottom portion 67*a* of the cylinder hole 67) of the second direction, the pivot shaft 53 rotates clockwise in FIG. 8. On the other hand, when the slide pin 64 presses the second projection 63 in a state in which the moving member 58 moves to the other side (the side of the plug member 68) of the second direction, the pivot shaft 53 rotates counterclockwise in FIG. 8. Hence, the inverter 59 alternately switches the rotation direction of the pivot shaft 53 to the one side and the other side.

When the pivot shaft 53 rotates, the rotation is converted into a reciprocal motion by the above-described converter 57 and transmitted to the third switching pin 33. In other words, the motion of the cam follower 22 is transmitted to the third switching pin 33 via the transmission 25 including the slide pin 64, the pivot shaft 53, the driving lever 54, the connecting lever 51, the pressing member 44, and the like, and the third switching pin 33 is driven in the direction to switch the driving state of the intake valves 4 or the exhaust valves 5.

The transmission 25 is located at a predetermined position by the positioner 24 to be described below. Here, the predetermined position includes a position (when in the first driving state) where the first rocker arm 27 and the second rocker arm 28 are in the connected state and a position (when in the second driving state) where the first rocker arm 27 and the second rocker arm 28 are in the non-connected state.

As shown in FIGS. 4 and 5, the positioner 24 includes a concave portion 81 in the concave member 61 of the pivot shaft 53, a presser 82 that engages with the concave portion 81, and a spring 83 that presses the presser 82 against the concave portion 81. The concave member 61 is fixed to the shaft end of the pivot shaft 53 in a state in which the concave member 61 pivots integrally with the pivot shaft 53, and substantially becomes a portion of the pivot shaft 53. For this reason, the concave portion 81 is provided in the pivot shaft 53 (transmission 25). As shown in FIGS. 9A to 9D, the presser 82 and the spring 83 are inserted and held in a non-through hole 84 of the housing 47. The presser 82 according to this preferred embodiment includes a ball. Additionally, the spring 83 according to this preferred embodiment includes a compression coil spring.

As shown in FIGS. 9A to 9D, the concave portion 81 includes a first concave portion 81*a* and a second concave portion 81*b* which are spaced apart by a predetermined angle in the rotation direction of the pivot shaft 53. The presser 82 engages with the first concave portion 81*a* in a state (a state in which the pivot shaft 53 rotates) in which the transmission 25 moves to the position where the first rocker arm 27 and the second rocker arm 28 are in the connected state. The presser 82 engages with the second concave portion 81*b* in a state (a state in which the pivot shaft 53 rotates) in which the transmission 25 moves to the position where the first rocker arm 27 and the second rocker arm 28 are in the non-connected state. For this reason, the positioner 24 positions the transmission 25 to the predetermined position defined by the first concave portion 81*a* or the second concave portion 81*b*.

A positioning interval A (see FIG. 9A) between the first concave portion 81*a* and the second concave portion 81*b* is larger than the moving amount (the rotation angle of the pivot shaft 53) of the transmission 25 when it is driven and moved by the synchronization cam 13. When the moving amount is represented by, for example, an angle B (an angle made by bisectors shown in FIG. 8) of the pivot shaft 53 driven and rotated by the synchronization cam 13, the positioning interval A=angle B+additional angle $\alpha$.

Each of the first concave portion 81*a* and the second concave portion 81*b* have a slope 85 such that an opening width becomes gradually narrower from the opening edge to the bottom. The pivot shaft 53 is driven by the synchronization cam 13 and rotates until the presser 82 abuts against the slope 85. For this reason, the position to which the pivot shaft 53 (transmission 25) is driven and moved by the synchronization cam 13 is a position where the presser 82 abuts against the slope 85 of the first concave portion 81*a* or the second concave portion 81*b* (see FIG. 9C). When the presser 82 presses the slope 85 in this manner, a thrust F acts in a direction (counterclockwise in FIG. 9C) in which the first and second concave portions 81*a* and 81*b* further move. Hence, the pivot shaft 53 is further rotated by the thrust F and reaches the predetermined position (see FIG. 9D) defined by the first concave portion 81*a* or the second concave portion 81*b*.

The spring force of the spring 83 that biases the presser 82 is set to a magnitude that allows the transmission 25 to be moved by the above-described thrust F to the predetermined position within the time when the intake valves 4 or the exhaust valves 5 are closed. In addition, the spring force is set to a magnitude that generates a position holding force in a state in which the presser 82 engages with the first concave portion 81*a* or the second concave portion 81*b*. The position holding force is a force that holds the pivot shaft 53 (transmission 25) at the predetermined position defined by the concave portion 81. In addition, the position holding force is set to a magnitude that prevents the pivot shaft 53 from being rotated by another force different from an actuating force generated when the synchronization cam 13 presses the cam follower 22. Here, "another force" can be, for example, the force of the slide pin 64 pressing the first projection 62 or the second projection 63 when the first projection 62 or the second projection 63 functions as the cam follower return cam 79. In addition, "a magnitude that prevents the pivot shaft 53 from being rotated" is a magnitude that prevents switching between the first driving state and the second driving state. The first driving state is the full cylinder operation state in which the first rocker arm 27 and the second rocker arm 28 are in the connected state. The second driving state is the partial cylinder operation state in which the first rocker arm 27 and the second rocker arm 28 are in the non-connected state.

The operation of the valve mechanism 1 for the engine 2 will be described next with reference to FIGS. 8, 9A to 9D, and 13 to 18. First, an operation performed when the operation state of the engine 2 is switched from the full cylinder operation state to the partial cylinder operation state by the switch assembly 3 will be described. When the full cylinder operation state is used, the driver 23 of the switch assembly 3 is set in the state shown in FIG. 8. That is, the moving member 58 of the driver 23 is moved to one end side (the side of the bottom portion 67*a* of the cylinder hole 67) by the oil pressure in the second oil passage 72. In addition, the driving lever 54 and the pivot shaft 53 are rotated clockwise in FIGS. 9A and 14. When the driving lever 54 is thus rotated, the pressing member 44 is located at the retreat position, and the first to third switching pins 31 to 33 are located at the connecting position. In this case, the first rocker arm 27 and the second rocker arm 28 are connected to each other and integrally swing.

The valve mechanism 1 of the engine 2 starts operating when the rotation of a crankshaft (not shown) is transmitted to the camshaft 14. When the rotation of the crankshaft is transmitted to the camshaft 14, the valve driving cam 12 and the synchronization cam 13 rotate. In the full cylinder operation state, the rotation of the valve driving cam 12 is transmitted from the first rocker arm 27 to the second rocker arm 28 via the first switching pin 31 and the second switching pin 32, and the intake valves 4 or the exhaust valves 5 are driven. At this time, since the cam follower 22 is located at the pressing end position, the synchronization cam 13 slips without pressing the cam follower 22.

To switch from the full cylinder operation state to the partial cylinder operation state, first, the oil pressure is supplied to the first piston 74 by the actuator 73 manually or automatically at an arbitrary time (see FIG. 13). At this time, the moving member 58 is biased by the oil pressure to the other end side (the left side or the side of the plug 68 in FIG. 13) on the opposite side of the current position in FIG. 13. When the oil pressure thus acts on the moving member 58, the moving member 58 moves to the side of the plug 68 against the spring force of the spring 78, and the slide pin 64 hits the cam surface 65 of the second projection 63 due to this movement. To further move the moving member 58 by the oil pressure from the state in which the slide pin 64 hits the second projection 63, the slide pin 64 needs to rise along the steep slope portion 65*a* of the cam surface 65 and move in a direction to press the cam follower 22.

In a case in which the nose portion 13*b* of the synchronization cam 13 faces the cam follower 22, the movement of the cam follower 22 in the direction to return to the pressing start position is regulated by the synchronization cam 13. For this reason, during the time in which the movement of the cam follower 22 is regulated, even if the oil pressure is applied to the moving member 58, the slide pin 64 never further moves to the side of the plug 68 from the state in which the slide pin 64 hits the second projection 63.

Figure 9B:
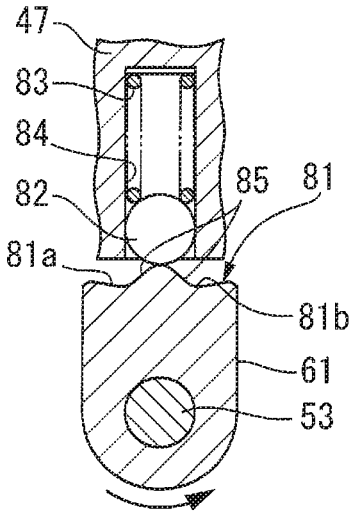
FIG. 9B is a sectional view of the positioner, which shows a state in which a presser moves across the boundary portion between one concave portion and the other concave portion.
Figure 9A:
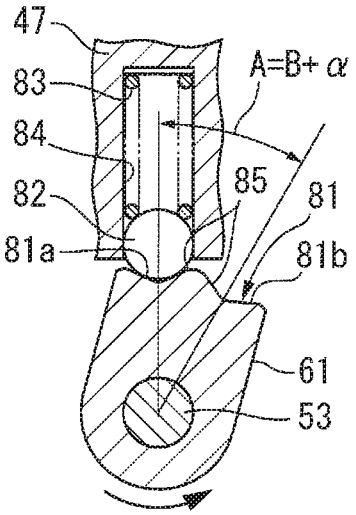
FIG. 9A is a sectional view of a positioner, which shows a state before the start of movement.

In a case in which the base circle portion 13*a* of the synchronization cam 13 faces the cam follower 22 when the synchronization cam 13 rotates from the above state while maintaining the supply of the oil pressure, or in a case in which the base circle portion 13*a* of the synchronization cam 13 faces the cam follower 22 when the oil pressure is applied to the moving member 58, the cam follower 22 is able to move in the direction to return to the pressing start position. For this reason, in either case, the oil pressure is applied to the moving member 58, and the moving member 58 thus moves in the cylinder hole 67 to the side of the plug 68 against the spring force of the spring 78. In addition, the slide pin 64 is pressed against the steep slope portion 65*a* and slides, and moves in a direction to approach the synchronization cam 13, as indicated by an alternate long and two short dashed line A in FIG. 10. At this time, the second projection 63 is pressed by the slide pin 64 but never tilts. This is because the presser 82 engages with the first concave portion 81*a*, as shown in FIG. 9A, and the pivotal movement of the pivot shaft 53 is regulated. Hence, the pressing member 44 is held at the retreat position, and the first to third switching pins 31 to 33 are held at the connecting position.

When the moving member 58 is further moved by the oil pressure, the slide pin 64 moves to a position indicated by an alternate long and two short dashed line C via a position indicated by an alternate long and two short dashed line B in FIG. 10. Here, the position indicated by the alternate long and two short dashed line B is a position where the slide pin 64 contacts the gentle slope portion 65*b*, that is, a position where the axis C1 of the pivot shaft 53 and the axis C2 of the slide pin 64 are located on the single plane P. The position indicated by the alternate long and two short dashed line C is a position where the cam follower 22 returns to the pressing start position. For this reason, when the moving member 58 moves in a state in which the cam follower 22 faces the base circle portion 13*a* of the synchronization cam 13, the cam follower 22 is pressed by the slide pin 64 and returns to the pressing start position, and a state shown in FIG. 13 is obtained.

Even when the moving member 58 and the slide pin 64 are moving as described above, the camshaft 14 is rotating. Hence, the nose portion 13*b* of the synchronization cam 13 may press the cam follower 22 in a state in which the slide pin 64 is in contact with the steep slope portion 65*a*, as indicated by the alternate long and two short dashed line A in FIG. 10. In this case, the slide pin 64 is pressed by the cam follower 22 and slides down on the steep slope portion 65*a*, and the moving member 58 retreats against the oil pressure.

Additionally, when the nose portion 13*b* of the synchronization cam 13 presses the cam follower 22 in a state in which the slide pin 64 moves to the position indicated by the alternate long and two short dashed line B in FIG. 10, the second projection 63 is pressed by the slide pin 64, as shown in FIG. 11, and the pivot shaft 53 rotates counterclockwise in FIG. 11. Then, the distal end of the slide pin 64 retracts into the concave portion 66. At this time, a small gap d1 is formed in the vertical direction of the slide pin 64, and the slide pin 64 never presses the pivot shaft 53. When the base circle portion 13*a* of the synchronization cam 13 faces the cam follower 22 in this state, the moving member 58 is pressed by the oil pressure and further moves, and the slide pin 64 moves to a position overlapping the gentle slope portion 65*b* of the second projection 63, as indicated by an alternate long and two short dashed line D in FIG. 11, and presses the cam follower 22 toward the pressing start position.

Figure 15:
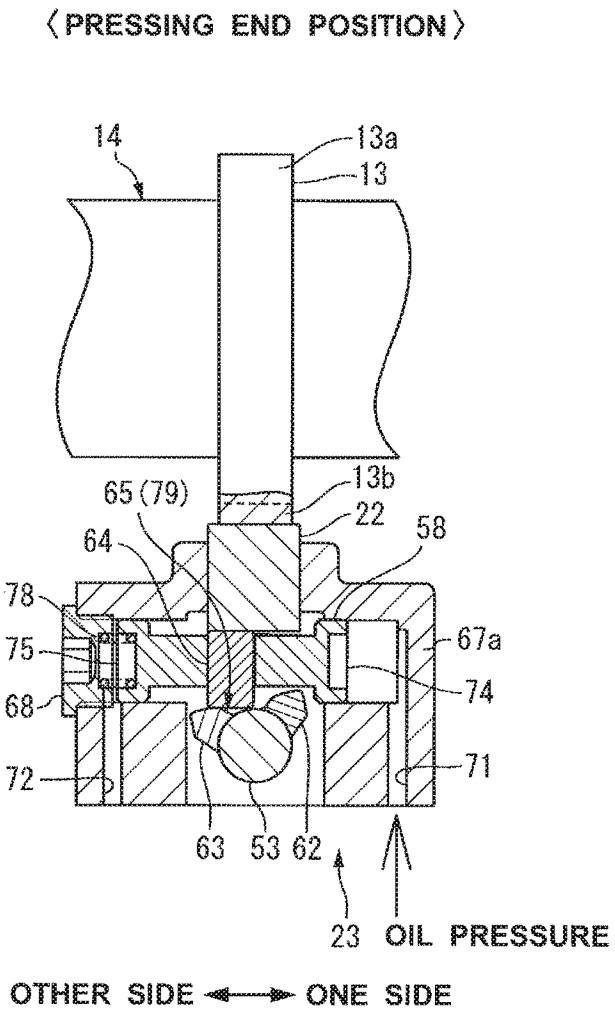
FIG. 15 is a sectional view of the driver taken along the line A-A in FIG. 5.

The cam follower 22 is returned from the pressing end position to the pressing start position side (FIG. 13) and then pressed again by the nose portion 13*b* of the synchronization cam 13 that is continuously rotating. The time when the cam follower 22 is pressed by the nose portion 13*b* of the synchronization cam 13 is the time when the intake valves 4 or the exhaust valves 5 are closed and the time when the first to third switching pins 31 to 33 of the switch assembly 3 are able to move. The cam follower 22 is pressed by the nose portion 13*b* of the synchronization cam 13 and thus moves to the pressing end position, as shown in FIG. 15.

When the cam follower 22 moves in this manner, the slide pin 64 presses the second projection 63 to the final position, and the pivot shaft 53 rotates in a direction (counterclockwise in FIG. 15) reverse to that in pressing the first projection 62. When the second projection 63 is pressed by the slide pin 64, and the pivot shaft 53 rotates, the first concave portion 81*a* and the second concave portion 81*b* of the positioner 24 move toward the presser 82 along with the rotation of the pivot shaft 53, as shown in FIGS. 9A to 9D. That is, when the pivot shaft 53 in the state shown in FIG. 9A starts rotating, first, as shown in FIG. 9B, the slope 85 of the first concave portion 81*a* presses the presser 82, and the presser 82 moves across the boundary portion between the first concave portion 81*a* and the second concave portion 81*b*. Then, when the pivot shaft 53 further rotates, the presser 82 enters the second concave portion 81*b*.

The operation of the synchronization cam 13 to press the cam follower 22 in this case ends before the presser 82 completely engages with the second concave portion 81*b*, that is, halfway through the engagement. For this reason, as shown in FIG. 9C, the synchronization cam 13 stops pressing the cam follower 22 halfway through the time when the presser 82 is pressing the slope 85 that defines a portion on the side of the opening edge of the second concave portion 81*b* by the spring force of the spring 83. When the presser 82 thus presses the portion on the side of the opening edge of the second concave portion 81*b*, the thrust F that further presses the pivot shaft 53 ahead in the rotation direction acts on the pivot shaft 53. As a result, after the operation of the synchronization cam 13 to press the cam follower 22 ends, the pivot shaft 53 is pressed by the above-described thrust F and further advances.

Figure 9D:
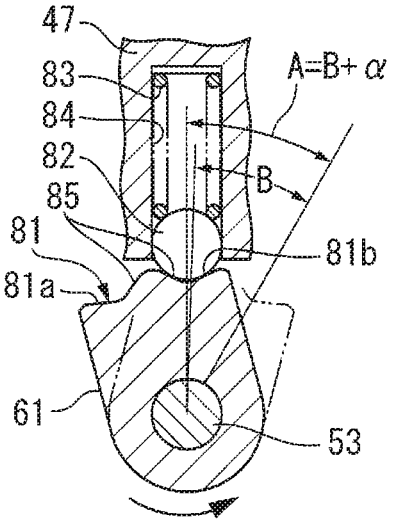
FIG. 9D is a sectional view of the positioner, which shows a state in which positioning is completed.
Figure 9C:
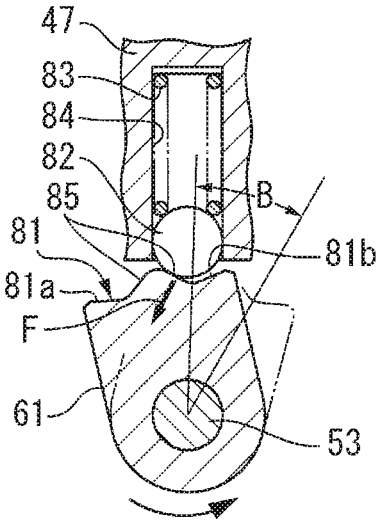
FIG. 9C is a sectional view of the positioner, which shows a state at the time when the operation of a synchronization cam to press a cam follower ends.
Figure 16:
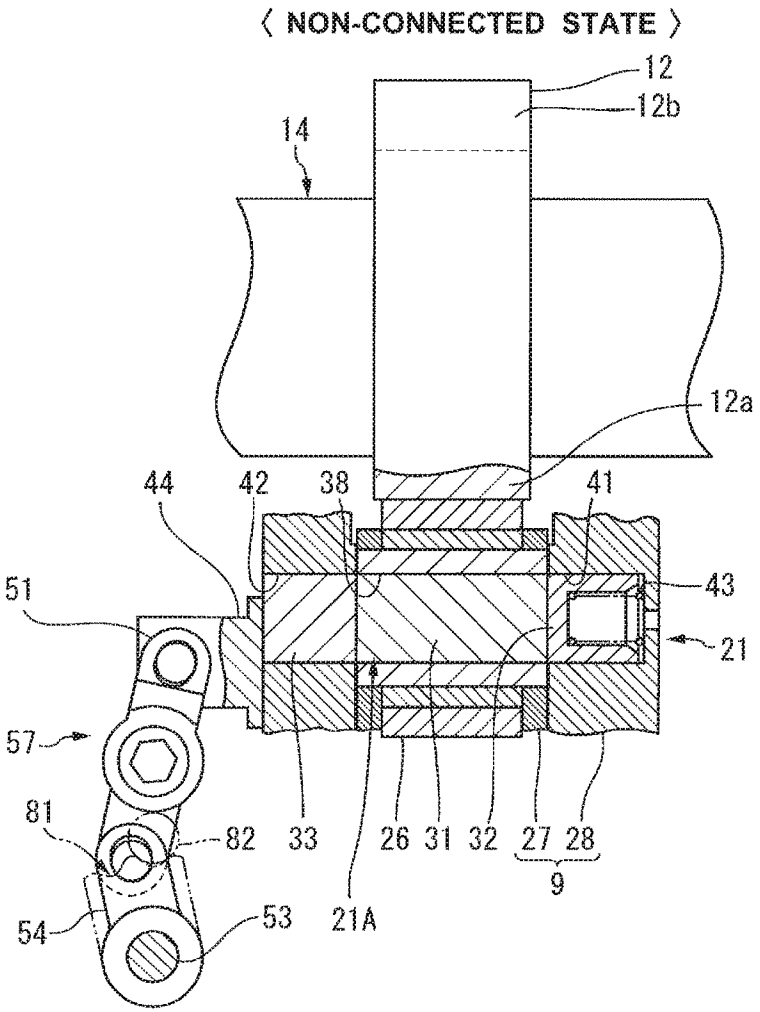
FIG. 16 is a sectional view of the switch unit taken along the line B-B in FIG. 5.

As shown in FIG. 9D, when the presser 82 completely engages with the second concave portion 81*b*, the pivot shaft 53 is located at the position defined by the second concave portion 81*b*. When the pivot shaft 53 is positioned in this manner, the driving lever 54 swings in the same direction, the pressing member 44 moves to the advance position, and simultaneously, the first to third switching pins 31 to 33 move to the non-connecting position, as shown in FIG. 16. At this time, since the first to third switching pins 31 to 33 are in a movable state, they are pressed by the pressing member 44 and smoothly move. As a result, the connected state between the first rocker arm 27 and the second rocker arm 28 is canceled. In this case, only the first rocker arm 27 swings along with the rotation of the valve driving cam 12, and the second rocker arm 28 stops. When the second rocker arm 28 stops, the intake valves 4 or the exhaust valves 5 are held in a closed and stopped state (deactivation state). For this reason, the operation state of the engine 2 is switched by the switch assembly 3 from the full cylinder operation state to the partial cylinder operation state.

To switch the operation state of the engine 2 from the partial cylinder operation state in which the intake valves 4 or the exhaust valves 5 are deactivated to the full cylinder operation state, the oil pressure is applied to the second oil passage 72 by the actuator 73, as shown in FIG. 17. When the supply of the oil pressure is switched in this manner, the moving member 58 is moved by the oil pressure to the side of the bottom portion 67*a* of the cylinder hole 67 when the base circle portion 13*a* of the synchronization cam 13 faces the cam follower 22.

Along with the movement of the moving member 58, the slide pin 64 slides while being pressed against the tilting first projection 62 and moves in a direction to approach the synchronization cam 13. When the slide pin 64 thus moves, the cam follower 22 is returned from the pressing end position to the pressing start position.

Figure 18:
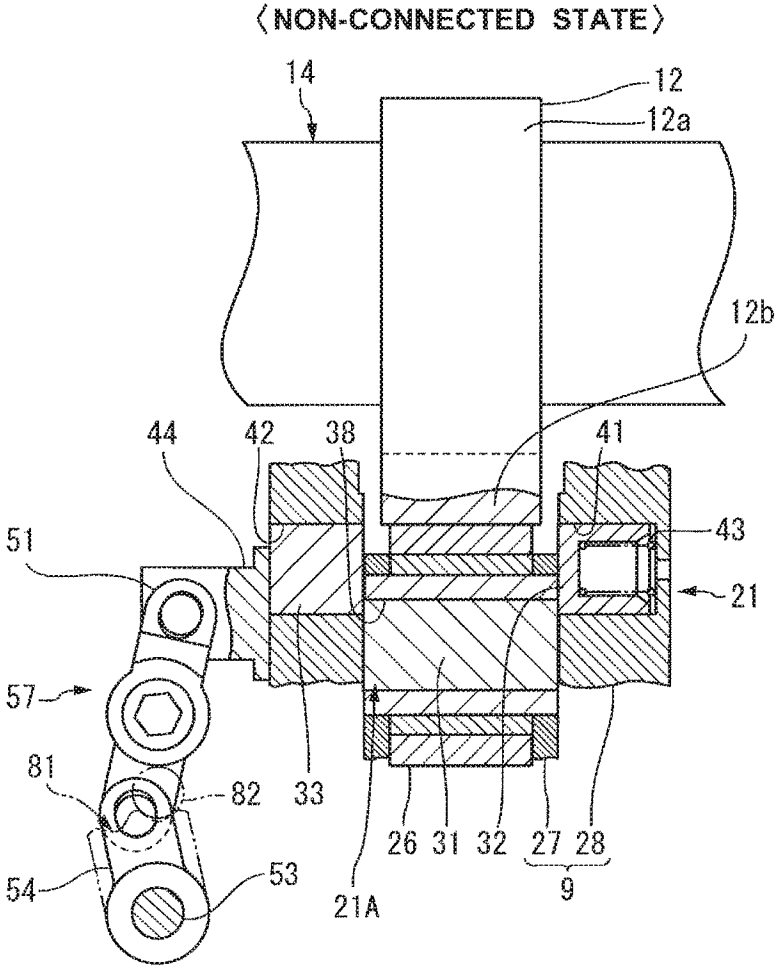
FIG. 18 is a sectional view of the switch unit taken along the line B-B in FIG. 5.

At this time, since the pivot shaft 53 does not rotate due to the action of the positioner 24, the pressing member 44 is held at the advance position, and the first to third switching pins 31 to 33 are held at the non-connecting position, as shown in FIG. 18.

When the synchronization cam 13 rotates in a state in which the cam follower 22 is located at the pressing start position (see FIG. 17), the nose portion 13*b* of the synchronization cam 13 comes into contact with the cam follower 22, and the cam follower 22 is pressed in a direction to the pressing end position. Then, the cam follower 22 moves to the pressing end position shown in FIG. 8. The time when the nose portion 13*b* of the synchronization cam 13 presses the cam follower 22 is the time when the base circle portion 12*a* of the valve driving cam 12 is in contact with the roller 26.

Then, along with the movement of the cam follower 22, the slide pin 64 moves to the same direction as the cam follower 22 and is pressed against the first projection 62. When the first projection 62 shown in FIG. 17 is pressed by the slide pin 64, the pivot shaft 53 rotates clockwise in FIG. 17 from the position shown in FIG. 17 to the position shown in FIG. 8. At this time, the presser 82 exits from the second concave portion 81*b* and enters the first concave portion 81*a*. After driving by the synchronization cam 13 ends, the pivot shaft 53 is further rotated by the thrust F that acts when the presser 82 presses the slope 85 of the first concave portion 81*a*. As a result, the pivot shaft 53 is located at the predetermined position defined by the first concave portion 81*a*.

Figure 14:
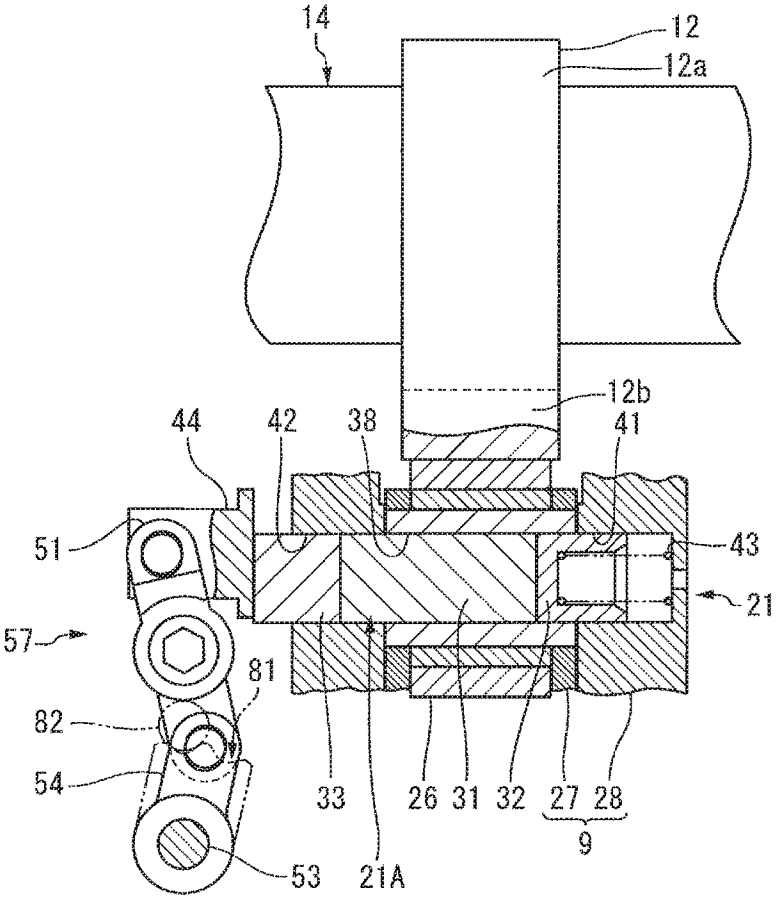
FIG. 14 is a sectional view of a switch unit taken along a line B-B in FIG. 5.

When the pivot shaft 53 thus rotates, the driving lever 54 swings clockwise in FIG. 18 from the position shown in FIG. 18 to the position shown in FIG. 14. The time when the driving lever 54 swings in this manner is the time when the intake valves 4 or the exhaust valves 5 are closed, and the driving force is not transmitted to the first arm main body 28*a* and the second arm main body 28*b* (when the movement of the first to third switching pins 31 to 33 is not regulated).

When the driving lever 54 thus swings, the pressing member 44 moves to the retreat position shown in FIG. 14, and the first to third switching pins 31 to 33 are moved to the connecting position by the spring force of the spring 43.

When the first to third switching pins 31 to 33 move to the connecting position in this manner, the first rocker arm 27 and the second rocker arm 28 are connected. As a result, the intake valves 4 or the exhaust valves 5 are driven by the valve driving cam 12, and the operation state of the engine 2 shifts to the full cylinder operation state.

For this reason, according to this preferred embodiment, it is possible to provide the valve mechanism in which a flip phenomenon does not occur since the transmission 25 that changes the driving state reliably operates only in a predetermined operation amount at an appropriate time. Since the flip phenomenon does not occur, the intake valves 4 or the exhaust valves 5 never abruptly close and break, and the first to third switching pins 31 to 33 never break due to an excessive load.

In the valve mechanism 1 shown in this preferred embodiment, if a manufacturing error of the transmission 25 from the cam follower 22 to the pivot shaft 53 is large, the operation amount generated when the first projection 62 or the second projection 63 is pressed by the slide pin 64 and the pivot shaft 53 rotates may vary. However, in the valve mechanism 1 according to this preferred embodiment, since the positioning interval A between the first concave portion 81*a* and the second concave portion 81*b* is larger than the moving amount B of the transmission 25 when it is driven and moved by the synchronization cam 13, the influence of the manufacturing error is small, and the operation amount of the pivot shaft 53 is almost constant. In addition, since the operation amount of the pivot shaft 53 is larger than the operation amount generated when the first projection 62 or the second projection 63 is pressed by the slide pin 64, and the pivot shaft 53 rotates, the height of the nose portion 13*b* of the synchronization cam 13 is small, and the driver 23 is made compact.

Each of the first and second concave portions 81*a* and 81*b* have the slope 85 such that the opening width becomes gradually narrower from the opening edge to the bottom. The position to which the pivot shaft 53 (transmission 25) is driven and moved by the synchronization cam 13 is the position where the presser 82 abuts against the slope 85 of the first concave portion 81*a* or the second concave portion 81*b*. The transmission 25 further moves due to the thrust F that acts when the presser 82 presses the slope 85, and reaches the predetermined position defined by the first concave portion 81*a* or the second concave portion 81*b*.

For this reason, in this preferred embodiment, since the thrust F acts on the transmission 25 when the presser 82 slides while pressing the slope 85 of the concave portion 81, the movement of the transmission 25 is smooth, and switching of the driving state of the intake valves 4 or the exhaust valves 5 is quickly performed. Hence, according to this preferred embodiment, it is possible to provide the valve mechanism with stable responsiveness when switching the driving state.

The spring force of the spring 83 that biases the presser 82 according to this preferred embodiment is set to a magnitude that allows the transmission 25 to be moved by the thrust F to the predetermined position within the time when the intake valves 4 or the exhaust valves 5 are closed.

For this reason, according to this preferred embodiment, since the switching operation of the driving state is completed within the time when the intake valves 4 or the exhaust valves 5 are closed, it is possible to provide the valve mechanism which has a high reliability in the switching operation.

The spring force of the spring 83 that biases the presser 82 according to this preferred embodiment is set to a magnitude that generates a position holding force that holds the transmission 25 at the predetermined position defined by the concave portion 81 in a state in which the presser 82 engages with the first concave portion 81*a* or the second concave portion 81*b*. The position holding force is set to a magnitude that prevents the first driving state and the second driving state from being switched by another force other than the actuating force generated when the synchronization cam 13 presses the cam follower 22.

For this reason, since the position of the transmission 25 is fixed in a state in which the synchronization cam 13 does not press the cam follower 22, an unintended operation of the switch assembly 3 or damage or a fault in the engine 2 caused by the operation of the switch assembly 3 is prevented.

The driver 23 according to this preferred embodiment includes the pivot shaft 53, the converter 57, and the inverter 59. The pivot shaft 53 rotates when the pressing force is transmitted from the cam follower 22. The inverter 59 alternately switches the direction of rotation of the pivot shaft 53 to one side and the other side. The converter 57 converts the pivotal motion of the pivot shaft 53 into a reciprocal motion and transmits it to one (third switching pin 33) of the elements in the valve mechanism system.

According to this preferred embodiment, the elements that transmit the pressing force from the synchronization cam 13 to the pivot shaft 53 and the elements of the inverter 59 and the elements in the converter 57 are arranged in the axial direction of the pivot shaft 53. It is therefore possible to provide the valve mechanism in which the driver 23 is compact.

Of the first projection 62 and the second projection 63 according to this preferred embodiment, one projection that interposes the slide pin 64 between the one projection and the cam follower 22 receives the pressing force, via the slide pin 64, from the cam follower 22 pressed by the synchronization cam 13, and causes the pivot shaft 53 to rotate in the direction in which the one projection is pressed. The other projection functions as the cam follower return cam 79 that presses the slide pin 64 toward the camshaft together with the cam follower 22 and returns the cam follower 22 when the slide pin 64 that presses the one projection moves in a direction to the other projection together with the moving member 58.

According to this preferred embodiment, the cam follower 22 is returned to the pressing start position using the first and second projections 62 and 63 that convert the reciprocal motion of the cam follower 22 into a pivotal motion. For this reason, since a mechanism exclusively used to return the cam follower 22 to the pressing start position is unnecessary, it is possible to decrease the number of elements and make the driver 23 compact.

Second Preferred Embodiment

Figure 19:
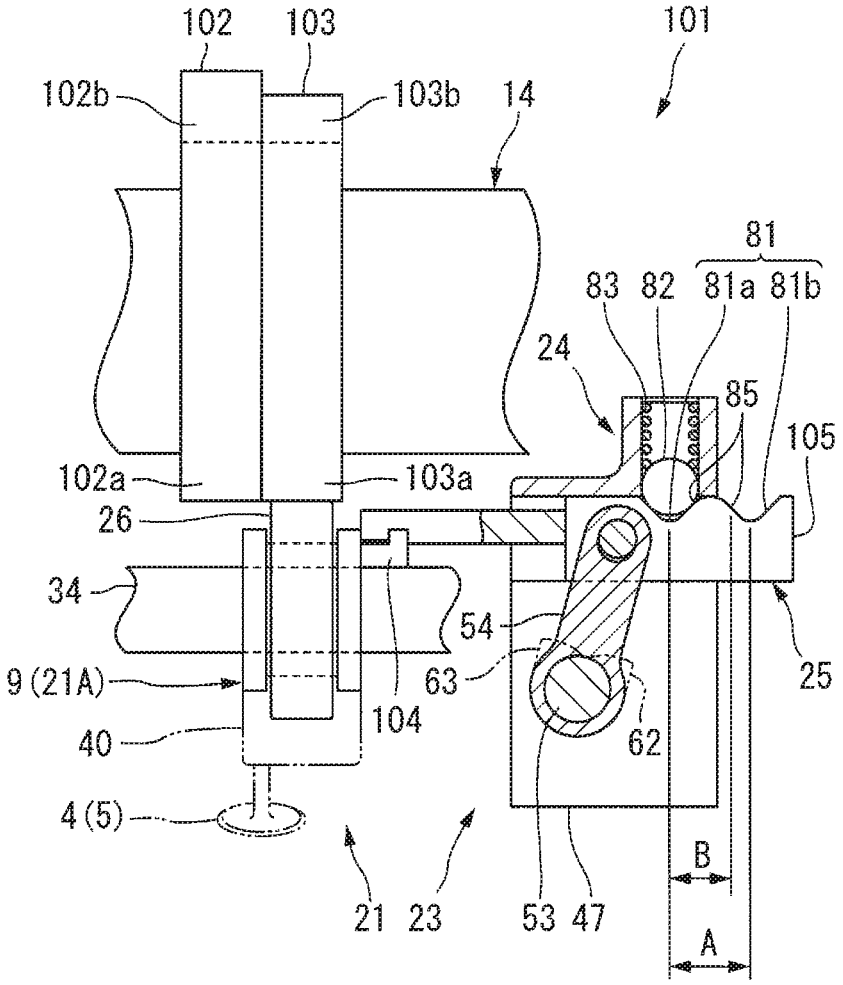
FIG. 19 is a plan view for explaining the structure of a camshaft and a switch unit according to a second preferred embodiment of the present invention, in which a sectional view of a driver is also illustrated.
Figure 20:
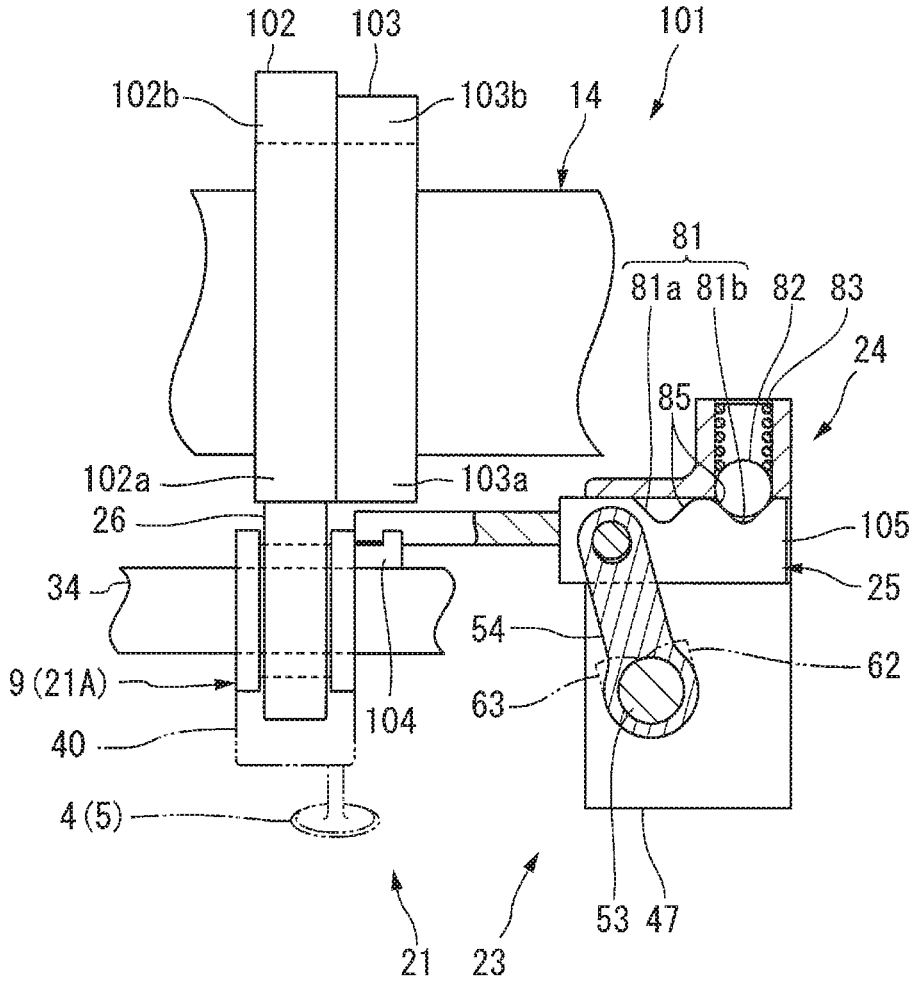
FIG. 20 is a plan view for explaining the structure of the camshaft and the switch unit according to the second preferred embodiment of the present invention, in which a sectional view of the driver is also illustrated.

A valve mechanism for an engine according to a preferred embodiment of the present invention is as shown in FIGS. 19 and 20. Elements that are the same as or similar to those described with reference to FIGS. 1 to 18 are denoted by the same reference numerals in FIGS. 19 and 20, and a detailed description thereof will appropriately be omitted. The valve mechanism for an engine according to this preferred embodiment is different from the valve mechanism shown in the first preferred embodiment in the structure of a camshaft 14 and a switch unit 21 of a switch assembly 3, but the rest of the structure is preferably the same as in the first preferred embodiment.

A valve mechanism 101 shown in FIG. 19 includes a first cam 102 and a second cam 103 having different valve lift amounts for an intake valve 4 or an exhaust valve 5 to switch between two types of driving states. The first cam 102 and the second cam 103 are arranged in the axial direction of the camshaft 14. The second cam 103 is arranged only on one side of the first cam 102 and is in contact with the first cam 102. The first cam 102 and the second cam 103 include base circle portions 102*a* and 103*a*, and nose portions 102*b* and 103*b*.

The outer diameter of the base circle portion 102*a* of the first cam 102 equals the outer diameter of the base circle portion 103*a* of the second cam 103. The nose portion 102*b* of the first cam 102 has a shape that generates a larger valve lift amount of the intake valve 4 or the exhaust valve 5 as compared to the nose portion 103*b* of the second cam 103.

A rocker arm 9 in the valve mechanism 101 is supported by a rocker shaft 34 to be movable in the axial direction and swingably supported by the rocker shaft 34. A pressing portion 40 that presses the intake valve 4 or the exhaust valve 5 is provided at the swing end of the rocker arm 9. The pressing portion 40 has a predetermined length in the axial direction of the rocker shaft 34. The length of the pressing portion 40 is equal to or longer than the interval (formation pitch) between the first cam 102 and the second cam 103.

The rocker arm 9 includes a roller 26 that contacts the first cam 102 or the second cam 103 and rotates, and a connecting portion 104 projecting in the axial direction of the rocker shaft 34. The connecting portion 104 is connected to a connecting member 105 of a driver 23. The connecting member 105 is pivotally connected to a driving lever 54 of the driver 23 and movably supported by a housing 47 so as to advance/retreat with respect to the rocker arm 9. A first concave portion 81*a* and a second concave portion 81*b* each of which engages with a presser 82 of a positioner 24 are provided in the connecting member 105. The first concave portion 81*a* and the second concave portion 81*b* according to this preferred embodiment are provided on one side of the connecting member 105 that translates while being arranged in the moving direction of the connecting member 105. A positioning interval A between the first concave portion 81*a* and the second concave portion 81*b* is larger than a moving amount B of a transmission 25 that is driven and moved by a synchronization cam 13.

As shown in FIG. 19, when a pivot shaft 53 of the driver 23 rotates in one direction, and the connecting member 105 moves to the retreat position shown in FIG. 19, the rocker arm 9 moves to a position corresponding to one cam (the second cam 103 in FIG. 19) of the first cam 102 and the second cam 103. In addition, as shown in FIG. 20, when the pivot shaft 53 rotates in the other direction, and the connecting member 105 moves to the advance position, the rocker arm 9 moves to a position corresponding to the other cam (the first cam 102 in FIG. 20) of the first cam 102 and the second cam 103.

When the camshaft 14 rotates in a state in which the roller 26 of the rocker arm 9 is in contact with the second cam 103 (see FIG. 19), the rocker arm 9 is pressed by the second cam 103 and swings. On the other hand, when the camshaft 14 rotates in a state in which the roller 26 of the rocker arm 9 is in contact with the first cam 102 (see FIG. 20), the rocker arm 9 is pressed by the first cam 102 and swings. For this reason, when the rocker arm 9 moves from the position where it is pressed by the second cam 103 to the position where it is pressed by the first cam 102, the valve lift amount of the intake valve 4 or the exhaust valve 5 becomes relatively large.

In this preferred embodiment, "a switch 21A that is one element of the valve mechanism system from the valve driving cam to the rocker arm" includes the rocker arm 9.

According to this preferred embodiment, it is possible to provide the valve mechanism for an engine, which correctly switches between a first driving state in which the valve lift amount of the intake valve 4 or the exhaust valve 5 becomes relatively large and a second driving state in which the valve lift amount of the intake valve 4 or the exhaust valve 5 becomes relatively small.

Third Preferred Embodiment

Figure 21:
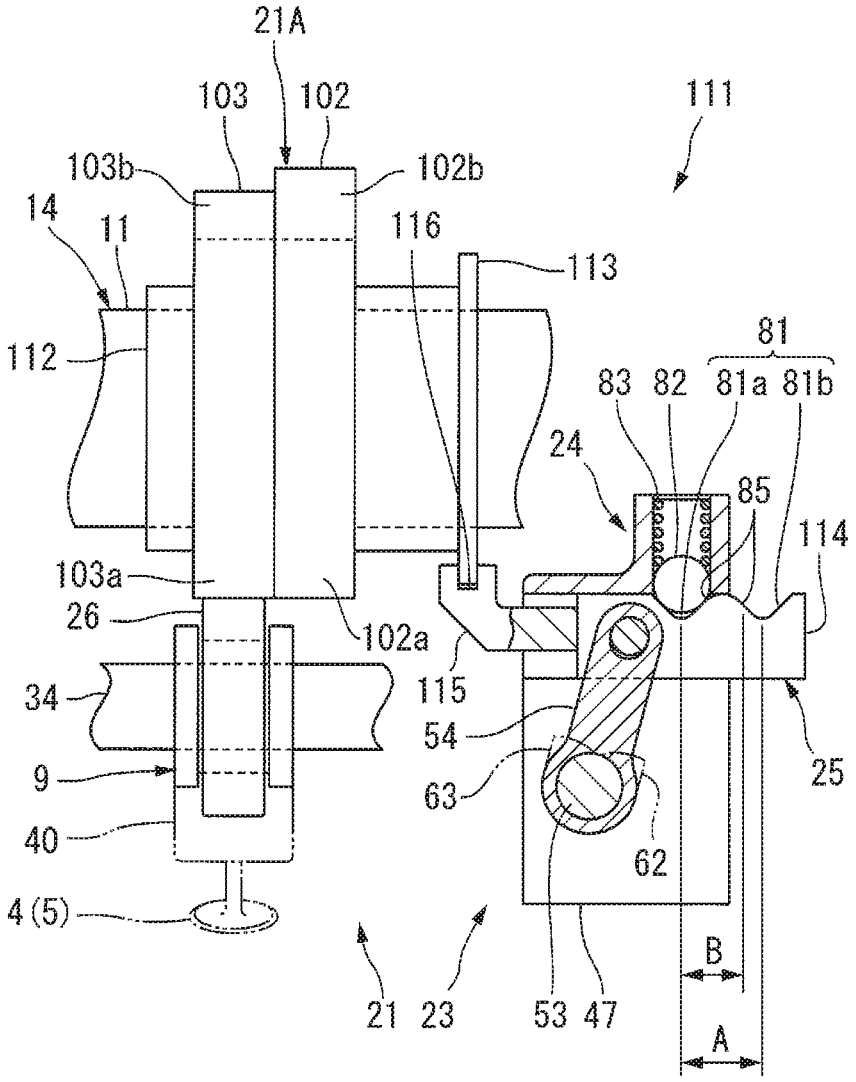
FIG. 21 is a plan view for explaining the structure of a camshaft and a switch unit according to a third preferred embodiment of the present invention, in which a sectional view of a driver is also illustrated.
Figure 22:
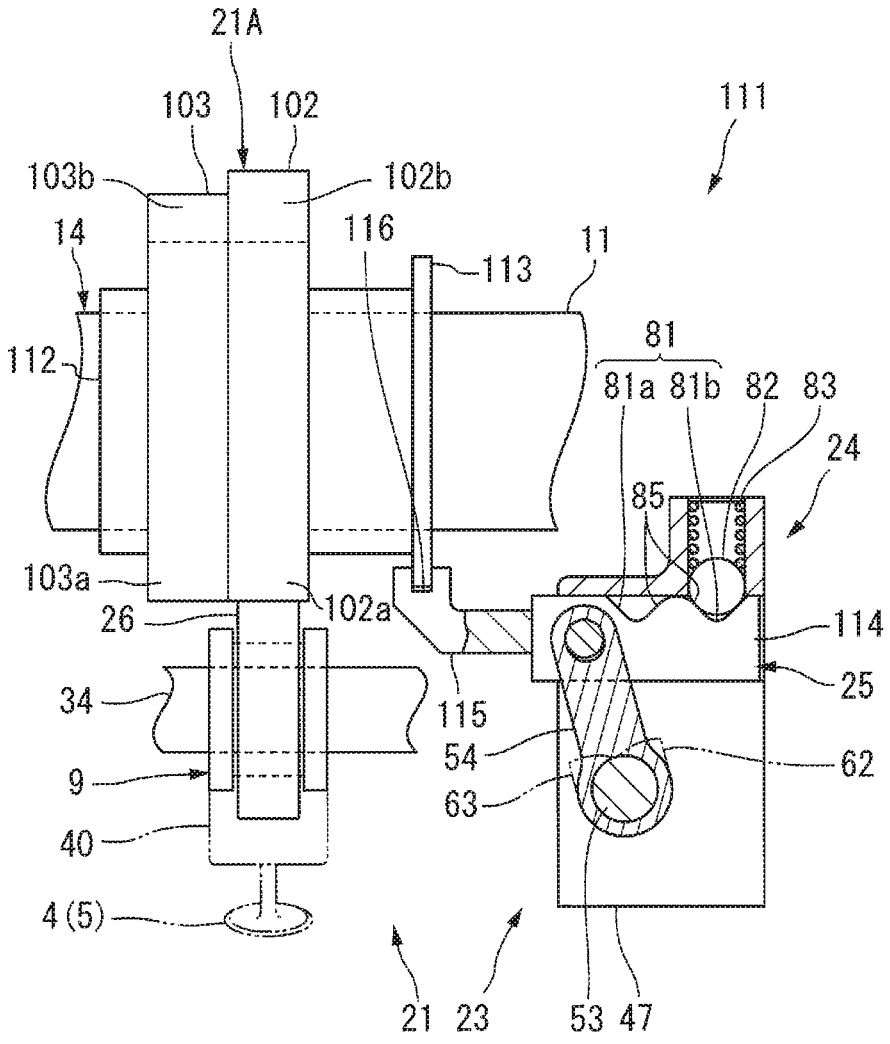
FIG. 22 is a plan view for explaining the structure of the camshaft and the switch unit according to the third preferred embodiment of the present invention, in which a sectional view of the driver is also illustrated.

A valve mechanism for an engine according to a third preferred embodiment of the present invention is shown in FIGS. 21 and 22. Elements that are the same as or similar to those described with reference to FIGS. 1 to 20 are denoted by the same reference numerals in FIGS. 21 and 22, and a detailed description thereof will appropriately be omitted.

The valve mechanism for an engine shown in this preferred embodiment is different from the valve mechanism shown in the second preferred embodiment in the structure of a camshaft 14 and a switch unit 21 of a switch assembly 3, but the rest of the structure is preferably the same as in the second preferred embodiment.

A valve mechanism 111 shown in FIG. 21 includes a first cam 102 and a second cam 103 having different valve lift amounts for an intake valve 4 or an exhaust valve 5 to switch between two types of driving states. The first cam 102 and the second cam 103 are arranged in the axial direction of a camshaft main body 11. A nose portion 102*b* of the first cam 102 has a shape that generates a larger valve lift amount of the intake valve 4 or the exhaust valve 5 as compared to a nose portion 103*b* of the second cam 103.

The first cam 102 and the second cam 103 according to this preferred embodiment are attached to the camshaft main body 11 via a tubular slider 112. The slider 112 is fitted on the outer peripheral portion of the camshaft main body 11 by, for example, a spline (not shown) in a state in which the camshaft main body 11 is inserted into the hollow portion. In other words, the slider 112 is supported by the camshaft main body 11 to be movable in the axial direction in a state in which the relative movement in the rotation direction is regulated. The first cam 102 and the second cam 103 are fixed to the slider 112 in a state in which the slider 112 extends through their axes.

An annular plate-shaped flange 113 is provided at one end of the slider 112 in the axial direction. The flange 113 is located on the same axis as the slider 112. The flange 113 is connected to a connecting member 114 of a driver 23. The connecting member 114 is pivotally connected to a driving lever 54 of the driver 23 and movably supported by a housing 47 so as to advance/retreat with respect to the first cam 102 and the second cam 103.

A connecting portion 115 is provided at the distal end of the connecting member 114. The connecting portion 115 includes a groove 116 in which the above-described flange 113 is slidably fitted. In addition, a first concave portion 81*a* and a second concave portion 81*b* of a positioner 24 are provided in the connecting member 114. The first concave portion 81*a* and the second concave portion 81*b* are provided on one side portion of the connecting member that translates while being arranged in the moving direction of the connecting member. A positioning interval A between the first concave portion 81*a* and the second concave portion 81*b* is larger than a moving amount B of a transmission 25 that is driven and moved by a synchronization cam 13.

According to this preferred embodiment, when a pivot shaft 53 of the driver 23 rotates, and the driving lever 54 swings in one direction, the connecting member 114 moves to the retreat position, and the slider 112 and the first cam 102 and the second cam 103 move to one side (the right side in FIG. 21) of the axial direction with respect to the camshaft main body 11, as shown in FIG. 21. When the driving lever 54 swings in a direction reverse to the above direction, the connecting member 114 moves to the advance position, and the slider 112 and the first cam 102 and the second cam 103 move to the other side of the axial direction with respect to the camshaft main body 11, as shown in FIG. 22.

A rocker arm 9 according to this preferred embodiment is swingably supported by a rocker shaft 34 in a state in which the movement in the axial direction is regulated. A roller 26 that rotates in contact with the first cam 102 or the second cam 103 is provided at the intermediate portion of the rocker arm 9. A pressing portion 40 that presses the intake valve 4 or the exhaust valve 5 is provided at the swing end of the rocker arm 9. The number of intake valves 4 or exhaust valves 5 to be driven by the rocker arm 9 is not limited by the arrangement of the switch unit 21. The rocker arm 9 according to this preferred embodiment may drive one intake valve 4 or exhaust valve 5 per cylinder, or drive two intake valves 4 or exhaust valves 5 per cylinder.

In this preferred embodiment, "a switch 21A that is one element of the valve mechanism system from the valve driving cam to the rocker arm" includes the first cam 102 and the second cam 103.

In the valve mechanism 111 according to this preferred embodiment, when the pivot shaft 53 of the switch assembly 3 rotates in one direction, the roller 26 comes into contact with the second cam 103, and the first cam 102 separates from the roller 26, as shown in FIG. 21. When the camshaft 14 rotates in this state, the rocker arm 9 is pressed by the second cam 103 and swings.

When the pivot shaft 53 rotates in the other direction, the second cam 103 separates from the roller 26, and the first cam 102 comes into contact with the roller 26, as shown in FIG. 22. When the camshaft 14 rotates in this state, the rocker arm 9 is pressed by the first cam 102 and swings.

For this reason, according to this preferred embodiment, it is possible to provide the valve mechanism in which the first cam 102 and the second cam 103 move, thus switching the driving state of the intake valve 4 or the exhaust valve 5.

In the above-described preferred embodiments, an example in which the presser 82 of the positioner 24 includes a ball has been described. However, the presser 82 is not limited to a ball and may be appropriately changed. For example, the presser 82 may have a sectional shape rising in a crescentic shape.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. A valve mechanism for an engine, the valve mechanism comprising:

a camshaft including a valve driving cam that drives one of an intake valve and an exhaust valve;

a rocker arm that converts a rotation of the valve driving cam into a reciprocal motion and transmits the reciprocal motion to one of the intake valve and the exhaust valve;

a synchronization cam that rotates in synchronism with the valve driving cam; and a switch assembly including a cam follower that is pressed and moved by the synchronization cam, and that switches, when the cam follower is pressed by the synchronization cam, a driving state of one of the intake valve and the exhaust valve to a first driving state or a second driving state; wherein the synchronization cam presses the cam follower at a time when one of the intake valve and the exhaust valve is closed;

the switch assembly includes:

a switch unit that switches the driving state when a switch moves;

a driver including a transmission that transmits a motion of the cam follower to the switch, and drives the switch via the transmission in a direction to switch the driving state; and a positioner that includes a presser that engages with a concave portion in the transmission, and positions the transmission at a predetermined position defined by the concave portion;

the concave portion includes:

a first concave portion with which the presser engages when the transmission moves to a position in the first driving state; and a second concave portion with which the presser engages when the transmission moves to a position in the second driving state; and a positioning interval between the first concave portion and the second concave portion is greater than a moving amount of the transmission when the transmission is driven and moved by the synchronization cam.

2. The valve mechanism according to claim 1, wherein the concave portion has a slope such that an opening width becomes narrower from an opening edge to a bottom;

a position to which the transmission is driven and moved by the synchronization cam is a position that the presser abuts against the slope of the concave portion; and the transmission is further moved by a thrust generated when the presser presses against the slope, and reaches a predetermined position defined by the concave portion.

3. The valve mechanism according to claim 2, further comprising a spring having a spring force that biases the presser and is set to a magnitude that causes the transmission to be moved by the thrust to the predetermined position within a time when one of the intake valve and the exhaust valve is closed.

4. The valve mechanism according to claim 1, further comprising a spring having a spring force that biases the presser and is set to a magnitude that generates a position holding force that holds the transmission in the predetermined position defined by the concave portion in a state in which the presser engages with one of the first concave portion and the second concave portion; and the position holding force is set to a magnitude that prevents the first driving state and the second driving state from being switched by a force other than an actuating force generated when the synchronization cam presses the cam follower.

5. The valve mechanism according to claim 1, wherein the driver includes:

a pivot shaft that rotates when a pressing force is transmitted from the cam follower;

an inverter that alternately switches a direction of the rotation of the pivot shaft between a first side and a second side; and a converter that converts a pivotal motion of the pivot shaft into a reciprocal motion and transmits the reciprocal motion to the switch.

6. The valve mechanism according to claim 5, wherein the pivot shaft includes:

a first projection projecting to a first side of a direction perpendicular or substantially perpendicular to an axial direction of the pivot shaft; and a second projection projecting to a second side of the direction perpendicular or substantially perpendicular to the axial direction of the pivot shaft;

the inverter includes:

a slide pin pressed by the cam follower;

a moving member that supports the slide pin movably in a first direction that is a moving direction of the cam follower, and movable in a second direction perpendicular or substantially perpendicular to the first direction; and an actuator that drives the moving member to the first side or the second side of the second direction;

the slide pin is disposed between the cam follower and the first projection when the moving member moves to the first side of the second direction, and is disposed between the cam follower and the second projection when the moving member moves to the second side of the second direction;

one of the first projection and the second projection that interposes the slide pin between the one projection and the cam follower receives the pressing force, via the slide pin, from the cam follower pressed by the synchronization cam, and causes the pivot shaft to rotate in a direction in which the one projection is pressed; and the other of the first projection and the second projection functions as a cam follower return cam that presses the slide pin toward the camshaft together with the cam follower and returns the cam follower when the slide pin that presses the one projection moves together with the moving member in a direction toward the other projection.

* * * * *